US006151459A

United States Patent [19]

Hashimoto et al.

[11] Patent Number: 6,151,459

[45] Date of Patent: Nov. 21, 2000

[54] DEVELOPMENT CARTRIDGE AND IMAGE FORMING APPARATUS

[75] Inventors: Kouji Hashimoto, Shizuoka-ken; Yoshiro Tsuchiya, Mishima; Kenji Matsuda, Numazu, all of Japan

[73] Assignee: Canon Kabushiki Kaisha, Tokyo, Japan

[21] Appl. No.: 09/386,438

[22] Filed: Aug. 31, 1999

[30] Foreign Application Priority Data

Aug. 31, 1998 [JP] Japan ..... 10-260918

[51] Int. Cl.[7] ..... G03G 15/00

[52] U.S. Cl. ..... 399/27; 399/12; 399/112

[58] Field of Search ..... 399/12, 27, 28, 399/30, 58, 61, 62, 64, 227, 112, 119, 111

[56] References Cited

U.S. PATENT DOCUMENTS

| | | | |
|---|---|---|---|
| 4,620,783 | 11/1986 | Tanaka et al. | 399/27 |
| 5,452,056 | 9/1995 | Nomura et al. | 399/111 |
| 5,485,249 | 1/1996 | Higeta et al. | 399/105 |
| 5,528,341 | 6/1996 | Shishido et al. | 399/109 |
| 5,559,581 | 9/1996 | Sugiura et al. | 399/111 |
| 5,561,496 | 10/1996 | Sugiura et al. | 399/107 |
| 5,581,325 | 12/1996 | Tsuda et al. | 399/116 |
| 5,585,902 | 12/1996 | Nishiuwatoko et al. | 399/106 |
| 5,617,188 | 4/1997 | Inomata | 399/30 X |
| 5,634,178 | 5/1997 | Sugiura et al. | 399/110 |
| 5,642,187 | 6/1997 | Nomura et al. | 399/111 |
| 5,650,841 | 7/1997 | Matsuda et al. | 399/111 |
| 5,659,847 | 8/1997 | Tsuda et al. | 399/113 |
| 5,678,139 | 10/1997 | Nomura et al. | 399/114 |
| 5,697,022 | 12/1997 | Matsuda et al. | 399/102 |
| 5,740,499 | 4/1998 | Higeta et al. | 399/105 |
| 5,740,500 | 4/1998 | Hashimoto | 399/114 |
| 5,768,660 | 6/1998 | Kurihara et al. | 399/111 |
| 5,787,323 | 7/1998 | Nomura et al. | 399/111 |
| 5,812,909 | 9/1998 | Oguma et al. | 399/103 |
| 5,825,472 | 10/1998 | Araki et al. | 399/111 |
| 5,839,028 | 11/1998 | Nomura et al. | 399/109 |
| 5,864,731 | 1/1999 | Ikemoto et al. | 399/27 |
| 5,878,309 | 3/1999 | Nomura et al. | 399/111 |
| 5,878,310 | 3/1999 | Noda et al. | 399/117 |
| 5,899,602 | 5/1999 | Noda et al. | 399/111 |
| 5,907,751 | 5/1999 | Kawaguchi et al. | 399/117 |
| 5,920,752 | 7/1999 | Karakama et al. | 399/111 |
| 5,923,918 | 7/1999 | Nakagawa et al. | 399/27 |
| 5,923,924 | 7/1999 | Hashimoto | 399/111 |
| 5,943,528 | 8/1999 | Akutsu et al. | 399/110 |
| 5,966,566 | 10/1999 | Odagawa et al. | 399/109 |
| 6,002,898 | 12/1999 | Yokomori et al. | 399/119 |

FOREIGN PATENT DOCUMENTS 9-274384 10/1997 Japan .

*Primary Examiner*—Sophia S. Chen
*Attorney, Agent, or Firm*—Fitzpatrick, Cella, Harper & Scinto

[57] ABSTRACT

A developing cartridge detachably mountable to the main assembly of an image forming apparatus includes a toner carrying member for carrying toner to a developing station at which an electrostatic image formed on an image bearing member is developed with the toner. The cartridge also includes a toner accommodating portion for accommodating the toner to be supplied to a developer carrying member. The cartridge further includes an engaging portion, the shape of which is different depending on the type of the toner it contains. The engaging portion is engageable with an engaging portion of one of two or more developing cartridge slots provided in a main assembly of the image forming apparatus. The cartridge also includes a light transmitting portion disposed in the engaging portion to transmit light to be detected by a detector provided in the main assembly of the image forming apparatus to detect the amount of the toner in the toner accommodating portion.

14 Claims, 25 Drawing Sheets

DEVELOPMENT CARTRIDGE AND IMAGE FORMING APPARATUS

FIELD OF THE INVENTION AND RELATED ART

The present invention relates to a development cartridge, and an image forming apparatus, such as an electrophotographic apparatus, in which a development cartridge can be installed.

A process cartridge system has been employed by a multi-color image forming apparatus based on an electrophotographic image formation process. According to a certain type of a process cartridge system, an electrophotographic photosensitive member and processing means, exclusive of a developing means, are integrated in the form of a cartridge which is removably installable in an electrophotographic image forming apparatus. A processing means is a means which works on an electrophotographic photosensitive member. Since a process cartridge system makes it possible for a user to maintain an image forming apparatus without relying on service personnel, it drastically improves operational efficiency. Therefore, a process cartridge system has been widely used in the field of a multi-color image forming apparatus.

A process cartridge such as the one described above is installed in the main assembly of an electrophotographic image forming apparatus by inserting the process cartridge into the process cartridge installing means of the main assembly, so that the process cartridge settles at a predetermined location. The developing means for a multi-color image forming apparatus comprises two or more cylindrical developer-bearing members. It is configured so that each of these developer-bearing members can be individually moved to a position at which it presses directly upon the electrophotographic photosensitive member in a process cartridge, or the electrophotographic photosensitive member which has been directly installed in the main assembly of an electrophotographic image forming apparatus.

The developing means also comprises a development rotary which rotates about an axis with which the main assembly is provided. The development rotary is configured so that it can removably hold two or more development cartridges. A process cartridge can be inserted into any of the cartridge slots of the development rotary. Therefore, whether or not each process cartridge has been installed into a proper slot is confirmed visually, or with the use of an optical device which reads the color label adhered to each development cartridge.

However, the aforementioned confirmation method has a problem in that the user who must deal with two or more development cartridges might install them in the wrong slots.

Also, it has been desired that the amount of toner (developer) in each development cartridge can be detected on the apparatus main assembly side so that a development cartridge in the development rotary can be replaced with a fresh one as soon as it runs out of toner.

SUMMARY OF THE INVENTION

The primary object of the present invention is to provide a development cartridge and an image forming apparatus which assure that the former is correctly positioned in the main assembly of the latter.

Another object of the present invention is to provide a development cartridge and an image forming apparatus which make it possible to detect the remaining amount of the toner in the development cartridge.

Another object of the present invention is to provide a development cartridge and an image forming apparatus which are better in terms of the position at which the remaining amount of the toner in the development cartridge is detected.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

The longitudinal direction in this embodiment is the direction which is perpendicular to the recording medium conveyance direction, that is, the direction which is parallel to the leading edge of the recording medium.

Next, the first embodiment of the present invention will be described with reference to the appended drawings.

General Structure of Electrophotographic Image Forming Apparatus

First, the overall structure of a full-color electrophotographic image forming apparatus will be described with reference to FIG. 1.

Figure 1:
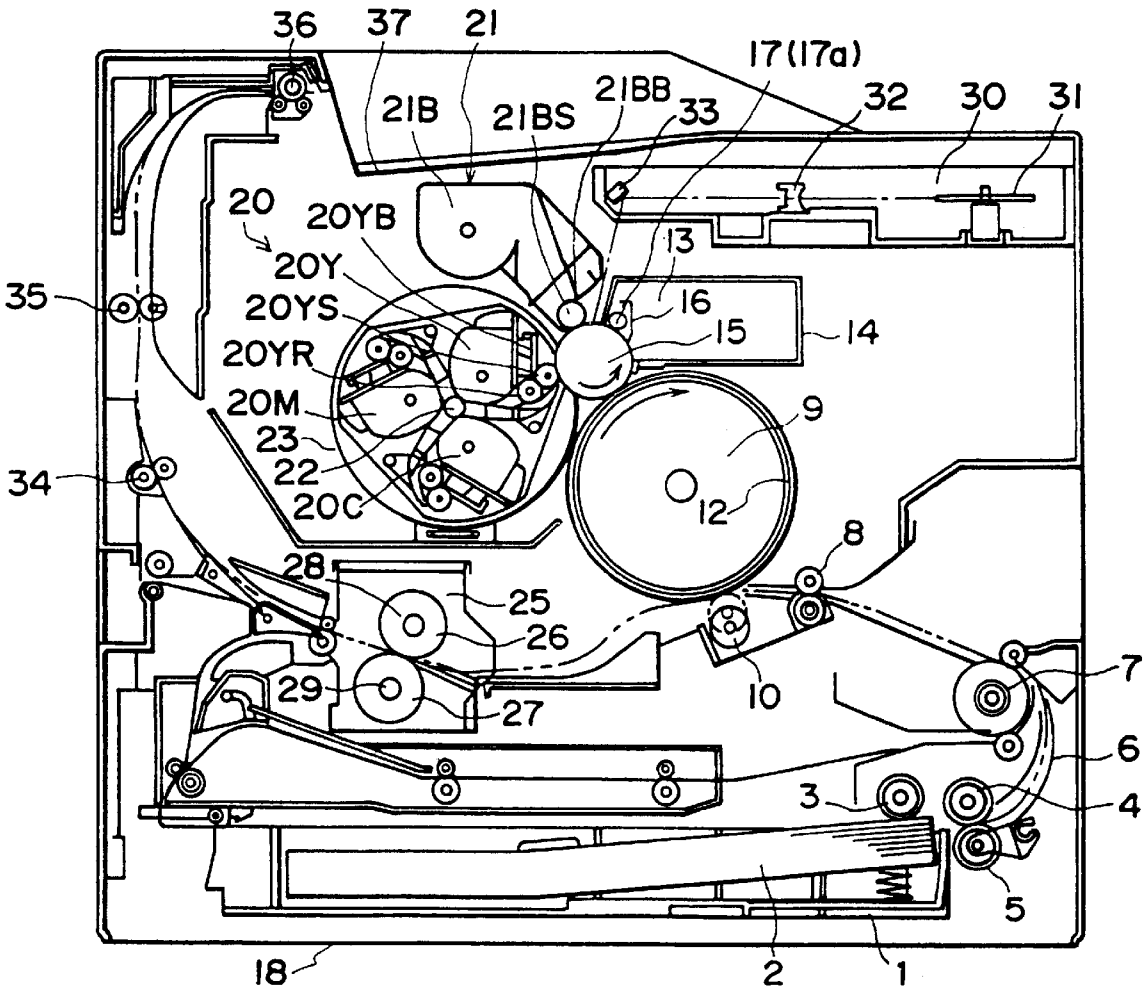
FIG. 1 is a vertical sectional view of an electrophotographic image forming apparatus.

FIG. 1 is a drawing which depicts the general structure of a full-color laser beam printer, a form of a full-color electrophotographic image forming apparatus.

As illustrated in FIG. 1, a color laser printer comprises an electrophotographic photosensitive member 15 (hereinafter, "photosensitive drum"), color developing devices 21B, 20Y, 20M and 20C, and an intermediary transfer member 9. These color developing devices are in the color forming section of the image forming apparatus. The color developing device 21B is a non-chromatic developing device and is fixed to a predetermined location. Color developing devices 20Y, 20M and 20C are chromatic developing devices and are rotationally movable about the axis of a development rotary. Intermediary transfer member 9 temporarily holds a full-color image composed of monocolor images which are developed in the image forming station, and transfers the full-color image onto a transfer medium 2 which is conveyed from a sheet feeding station. After the transfer of the full-color image onto the recording medium 2, the recording medium 2 is conveyed to a fixing station, in which the full-color image is fixed to the recording medium 2. Then, the recording medium 2 is discharged by discharge rollers 34, 35, and 36 into a delivery station 37. The color developing devices 20Y, 20M, and 20C which can be rotationally and selectively moved to a predetermined location, and the nonrotational non-chromatic developing device 21B, are configured so that they can be individually and removably installed in main assembly 18 of the electrophotographic image forming apparatus.

Next, the structures of the various sections of the electrophotographic image forming apparatus will be described in detail in a logical order.

Process Cartridge

The process cartridge 13 integrally comprises a photosensitive drum 15, a cleaning blade 16, a charging means 17 for primary charge, and a cleaning means chamber 14. The cleaning means chamber 14 doubles as a holder for the photosensitive drum 15. The process cartridge 13 is removably installable in main assembly 18 of the electrophotographic image forming apparatus, so that it can be easily replaced by the user according to the service life of photosensitive drum 15. The photosensitive drum 15 in this embodiment consists of an aluminum cylinder, and a layer of organic photoconductor coated on the peripheral surface of the aluminum cylinder. It is rotationally supported by the wall of cleaning means chamber 14. The cleaning means chamber 14 contains a cleaning blade 16 and a charging means 17 for primary charge. The cleaning blade 16 is disposed so that it makes contact with the peripheral surface of the photosensitive drum 15. The photosensitive drum 15 is partially exposed from the opening of the cleaning means chamber 14. The photosensitive drum 15 is rotated counterclockwise by the driving force transmitted from an unillustrated motor, in synchronism with the progress of an image formation operation.

The charging means 17 in the process cartridge 13 is a charging means which employs a contact type charging method. In a charging operation, an electrically conductive roller 17*a* of the charging means 17 is placed in contact with the photosensitive drum 15, and the peripheral surface of the photosensitive drum 15 is uniformly charged as voltage is applied to the electrically conductive roller 17*a*.

The process cartridge is a cartridge created by integrating a charging means, a cleaning means, and an electrophotographic photosensitive member in the form of a cartridge which is removably installable in the image assembly of an electrophotographic image forming apparatus. It must integrally comprise an electrophotographic photosensitive member and a minimum of a charging means or a cleaning means.

Exposing Means

The operation for exposing the photosensitive drum 15 is carried out by scanner portion 30. More specifically, image formation signals are given to a laser diode. The laser diode emits a beam of image formation light modulated by the image formation signals, toward a polygon mirror 31 which is being rotated at a high velocity and deflects the beam of image formation light. Then, the beam of image formation light passes through a focusing lens 32 and a mirror 33, and reaches the photosensitive drum 15 which is rotating at a predetermined peripheral velocity. As the beam of image formation light reaches the photosensitive drum 15, it selectively removes electrical charge from the peripheral surface of the photosensitive drum 15. As a result, an electrostatic latent image which reflects the image formation data is formed on the peripheral surface of the photosensitive drum 15.

Developing Means

Developing means 20 and 21 are means for developing an electrostatic latent image. The developing means 20 has three developing devices 20Y, 20M and 20C which make it possible for an electrophotographic image forming apparatus to develop an electrostatic latent image into yellow, magenta, and cyan colors, correspondingly. The developing means 21 has a developing device 21B which enables an electrophotographic image forming apparatus to develop an electrostatic latent image into a black image.

The black image developing device 21B of the developing means 21 is a stationary device. It is fixed to a location at which the peripheral surface of the developing roller 21BS, as a developer bearing member, squarely faces the peripheral surface of the photosensitive drum 15, with the presence of a microscopic gap between the two surfaces. The developing device 21B develops an electrostatic latent image into a visible image, that is, an image composed of black toner.

The black image developing device 21B has a toner conveyance mechanism, a development roller 21BS, and a toner coating blade 21BB. The toner coating blade 21BB is in contact with the peripheral surface of the development roller 21BS. The toner within the device 21B is conveyed toward the development roller 21BS by the toner conveyance mechanism, and coated on the peripheral surface of the development roller 21BS which is being rotated counterclockwise (FIG. 1). While the toner is coated, it is triboelectrically charged. As development bias is applied to the development roller 21BS, the toner is supplied from the development roller 21BS to the photosensitive drum 15. As a result, the electrostatic latent image on the photosensitive drum 15 is developed.

Sheet Conveying Means

The sheet conveying means is a means for conveying the recording medium 2 to the image forming station. The sheet conveying means comprises a sheet feeder cassette 1, a conveyor rollers 3 and 4, a regard roller 5, a sheet guide 6, and a registration roller 8. The sheet feeder cassette 1 holds two or more sheets of recording medium. The regard roller 6 prevents two or more sheets from being conveyed together. In an image forming operation, the conveyer roller 3 rotates in synchronism with the progress of the image forming operation to feed out the recording media 2 within the sheet feeder cassette 1 one by one while separating them. After being fed out of the cassette 1, the recording medium 2 is guided to the registration roller 8 by the sheet guide 6 past the conveyer roller 7. The registration roller 8 intermittently rotates so that the recording medium 2 is conveyed to the intermediary transfer member while being kept on standby during the rotational intermission of the registration roller. This intermittent rotation of the registration roller 8 aligns the recording medium 2 with the toner image during the toner image transfer.

Transfer Station

The transfer station has a transfer roller 10, which is pivotable.

The transfer roller 10 consists of a metallic shaft and an elastic member wrapped around the metallic shaft. It is vertically pivotable so that it can be moved to the top or bottom position. It rotates by receiving driving force. While four toner images of different color are formed on the intermediary transfer member 9, the transfer roller 10 is caused to remain at the bottom position, outlined by a bold solid line in the drawing, so that the toner images are not disturbed by the transfer roller 10. In other words, during the formation of the four toner images, the transfer roller 10 is kept separated from the intermediary transfer member 9. After the formation of the four toner images on the intermediary transfer member 9, the transfer roller 10 is moved to the top position, outlined by a fine solid line in the drawing, in synchronism with the timing for transferring the full-color image (composed of four toner images of different color) onto the recording medium 2. As the transfer roller 10 is moved to the top position, it presses the recording medium 2 upon the intermediary transfer member 9, generating a predetermined amount of pressure. In this state, bias is applied to the transfer roller 10, so that the toner images on the intermediary transfer member 9 are transferred onto the recording medium 2. The intermediary transfer member 9 and transfer roller 10 are individually driven. Therefore, the recording medium 2 pinched between the two rollers is conveyed leftward in the drawing, reaching the next processing station, that is, a fixing station, as the toner images are transferred.

Fixing Station

The fixing station is a station in which the unfixed toner images, which have been transferred from the intermediary transfer member 9, are fixed to the recording medium 2. As shown in FIG. 1, the fixing station 25 has a fixing roller 26 and a pressure roller 27. The fixing roller 26 has a heater 28 and applies heat to the recording medium 2, and the pressure roller 27 has a heater 29 and presses the recording medium 2 upon the fixing roller 26.

Image Forming Operation

Figure 2:
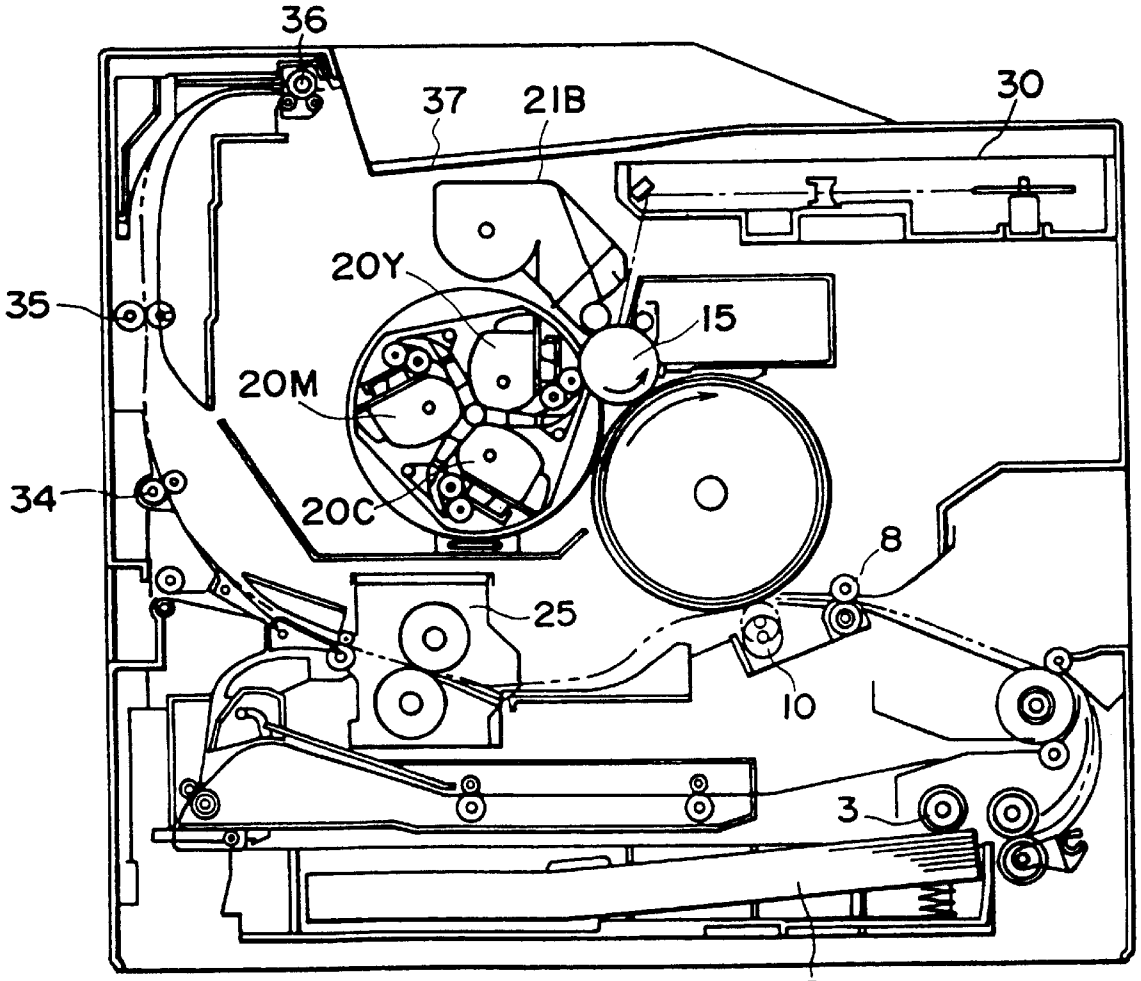
FIG. 2 is a vertical sectional view of an electrophotographic image forming apparatus.

Next, referring to FIG. 2, the operation of the electrophotographic image forming apparatus will be described.

First, the sheet feeder roller 3 is rotated so that the recording media 2 within the sheet feeder cassette 1 are fed out one by one while being separated, and are conveyed to the registration roller 8.

Meanwhile, the photosensitive drum 15 and intermediary transfer member 9 are rotated at the same peripheral velocities in the directions indicated by arrow marks in the drawing.

The developing devices 20Y, 20M, and 20C have been removably mounted in the development rotary 23. The development rotary can be rotated about the center shaft 22 during the image formation while holding the developing devices, so that the developing devices 20Y, 20M, and 20C can be individually moved to a predetermined position at which a development roller, for example, the development roller 20YS (development roller 20MS and 20CS, which have not been given a referential character in the drawing), squarely faces the photosensitive drum 15, holding a microscopic gap (approximately 300 $\mu$m) from the photosensitive drum 15. After being accurately positioned in the development station, a developing device (developing device 20Y in the drawing) develops the electrostatic latent image on the photosensitive drum 15. During an operation for forming a full-color image, the development rotary 23 rotates once for each rotation of the intermediary transfer member 9. The order in which latent images are developed is the developing devices 20Y, 20M, 20C and 21B for yellow, magenta, cyan, and black colors, correspondingly.

FIG. 1 shows a state of the image forming apparatus, in which the developing device 20Y for yellow color has been moved to the position at which it squarely faces the process cartridge 13. The developing device 20Y for yellow color has a toner conveying mechanism, a toner coating roller 20YR, a development roller 20YS, and a development blade 20YB. The toner conveying mechanism conveys the toner within the device 20 to the toner coating roller 20YR. The toner coating roller 20YR is rotated clockwise. The development blade 20YB is placed in contact with the peripheral surface of the development roller 20YS, with the application of a predetermined amount of pressure. Thus, as an image forming operation is started, the toner within the device 20Y is coated on the peripheral surface of the development roller 20YS while being triboelectrically charged. Then, as development bias is applied to the development roller 20YS, a latent image on the photosensitive drum 15 is developed.

The developments by the magenta color developing device 20M and cyan color developing device 20C are carried out in the same manner as the manner described above.

As the development rollers of the developing devices 20Y, 20M, and 20C move, they are automatically connected to a development power source and a driving force transmitting mechanism with which the image forming apparatus main assembly 18 is provided.

Intermediary Transfer Member

In order to receive in layers four toner images (yellow, magenta, cyan, and black toner images) from the photosensitive drum 15 on which the toner images have been formed, the intermediary transfer member 9 rotates clockwise (in the drawing) at the same peripheral velocity as that of the photosensitive drum 15. After being transferred onto the intermediary transfer member 9, the four toner images are transferred in layers onto the recording medium 2 by the transfer roller 10.

The intermediary transfer member 9 in this embodiment consists of an aluminum cylinder 12, and an elastic layer which covers the peripheral surface of the aluminum cylinder 12. It is rotationally supported and rotates by receiving driving force through a gear (unillustrated) which is integral with the intermediary transfer member 9.

Cleaning Means

A cleaning blade 16 is an integral part of the process cartridge 13, and extends along the generatrix of the photosensitive drum 15, in contact with the peripheral surface of the photosensitive drum 15. It is a blade which cleans the photosensitive drum 15 by scraping away the toner which remains on the peripheral surface of the photosensitive drum 15 after a toner image is formed on the peripheral surface of the photosensitive drum 15 and transferred onto the intermediary transfer member 9. The toner scraped away from the photosensitive drum 15 collects in the cleaning means chamber 14. The amount of the toner which collects in the cleaning chamber 14 is not large enough to fill the chamber 14 before the service life of the photosensitive drum 15 expires.

In this embodiment, in order to form a single full-color image on the intermediary transfer member 9, four toner images of different color, that is, a yellow toner image, a magenta toner image, a cyan toner image, and a black toner image, are sequentially transferred in layers onto the intermediary transfer member 9, in the listed order.

Color Developing Devices

Figure 3:
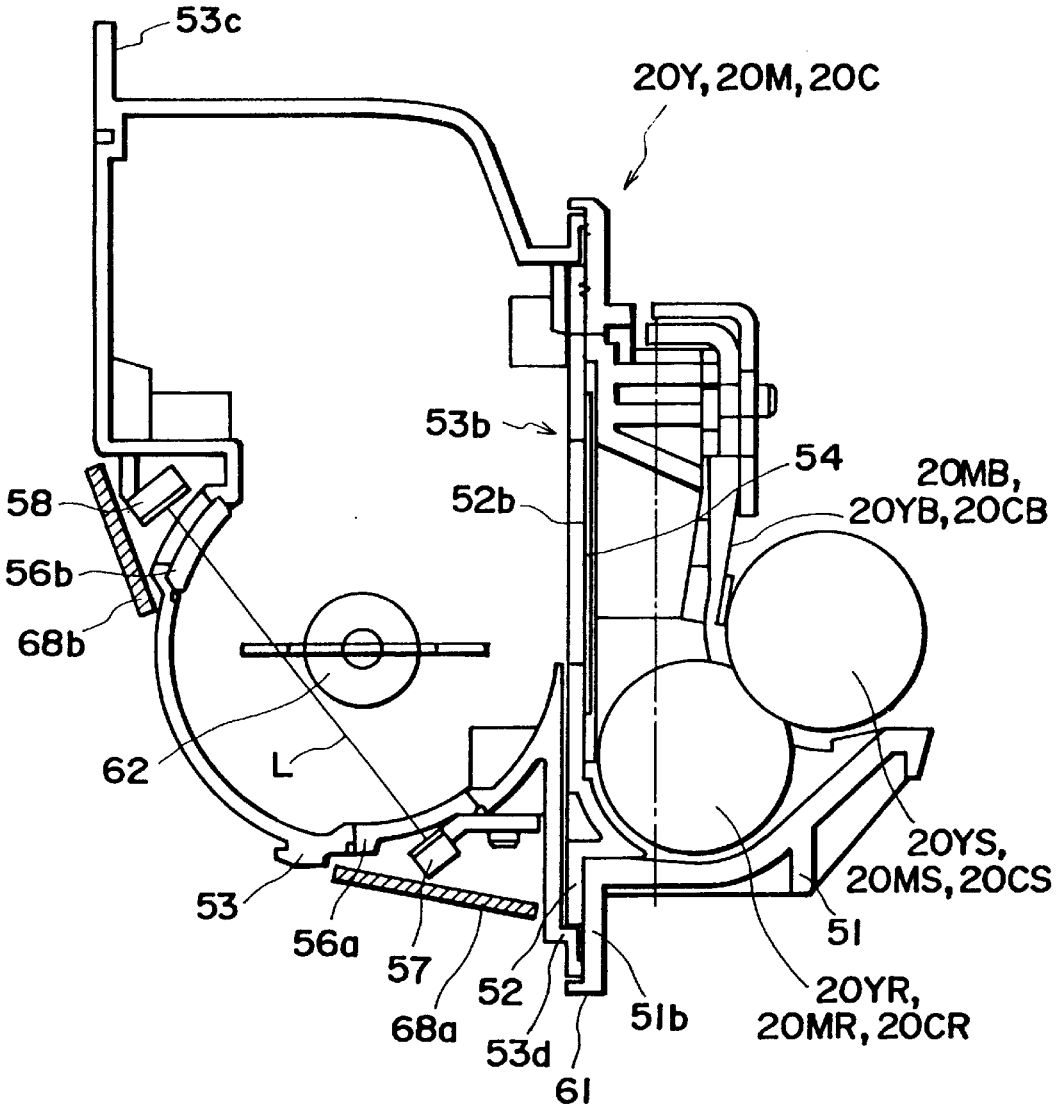
FIG. 3 is a vertical sectional view of a development device.
Figure 4:
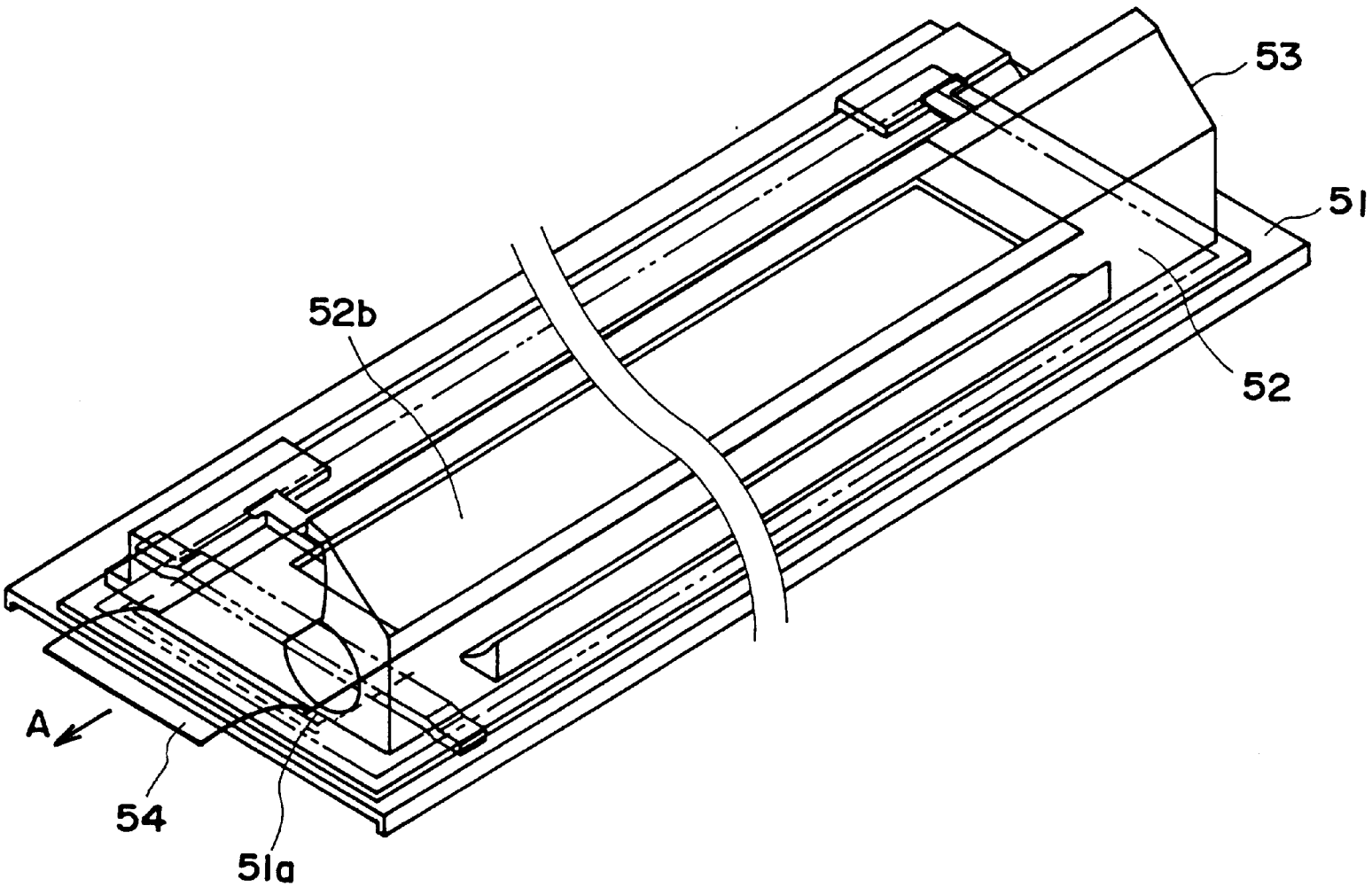
FIG. 4 is a schematic, perspective, phantom view which depicts a toner seal.

Next, the structure of a development cartridge (developing device), which characterizes the present invention, will be described in detail with reference to FIGS. 3–16. In FIG. 3, the developing devices 20Y, 20M, and 20C are in the form of a development cartridge, and can be removably installed in the main assembly 18. Each development cartridge consists of various internal components, for example, a toner coating roller (rollers 20YR, 20MR, and 20CR), a development roller (development rollers 20YS, 20MS, and 20CS), and the like, and a development means housing 51 into which the various components are integrally assembled. Referring to FIGS. 3 and 4, the development cartridge also comprises a developer container 53 which is welded to the housing 51. The developer container 53 is provided with an opening 53*b* with a predetermined size. The developer container 53 also comprises a developer container cover 52 with an opening 52*b* which is sealed with a seal 54, which is removably adhered to the cover 52 by welding or the like.

When a development cartridge is used for the first time, a user must remove the seal 54 through a gap 51*a* by pulling the seal 54 in the direction indicated by an arrow mark A, so that the toner which has been stored in the developer container 53 is released through the opening 52*b* of the cover 52 to be supplied to the toner coating roller (toner coating rollers 20YR, 20MR, and 20CR) in the development means housing 51.

Detecting of Remaining Toner

Referring to FIG. 3, the developer container 53 is provided with transparent windows 56*a* and 56*b* for detecting the remaining amount of the toner in the developer container 53. The transparent windows 56*a* and 56*b* are formed by insert molding.

Figure 5:
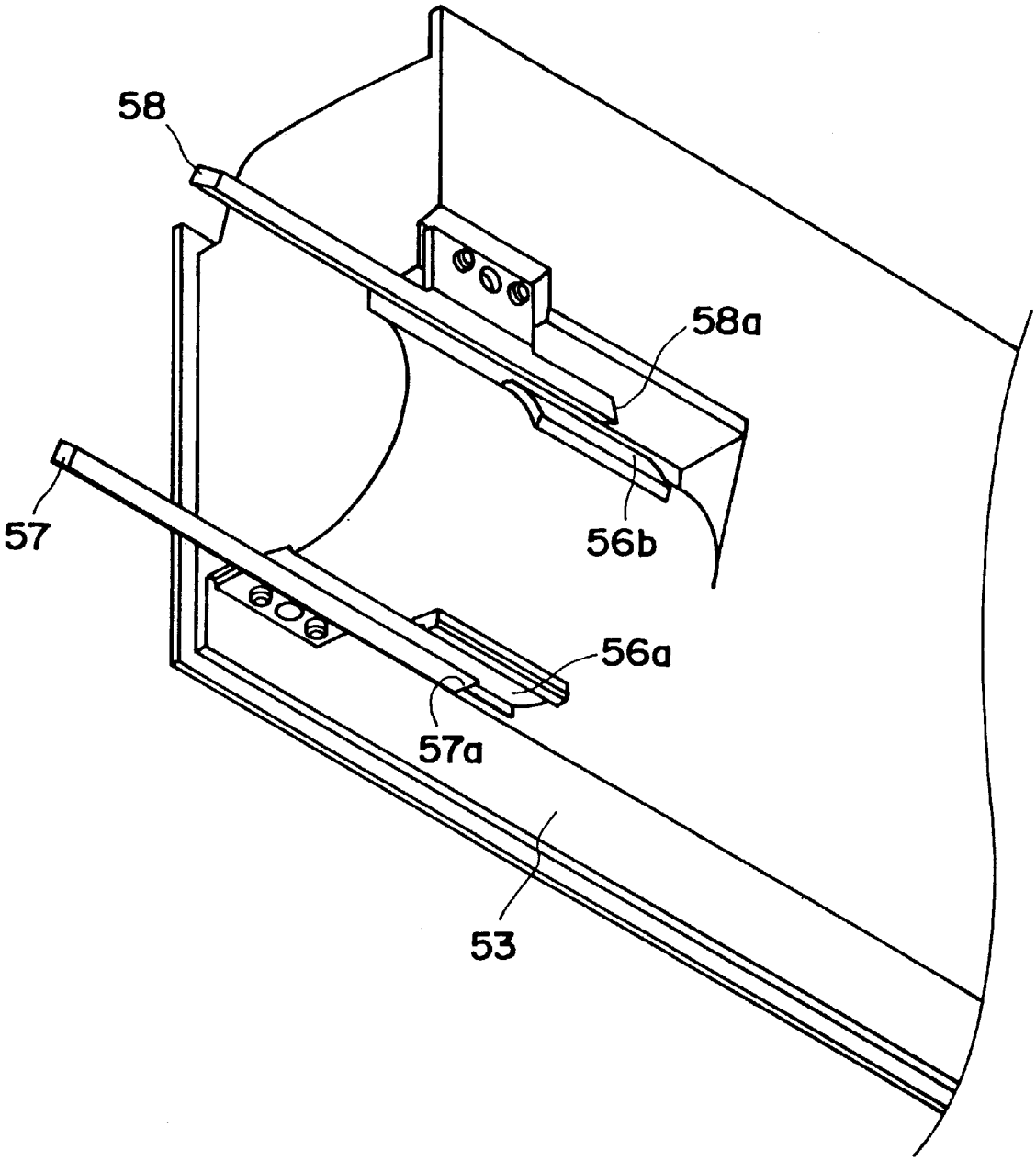
FIG. 5 is a perspective view of an essential portion of the rear side of a developer container, with the bottom side facing upward.

Referring to FIG. 5, there are light transmitting members 57 and 58 which are fixed to the exterior of the developer container 53 of each developing device (developing devices 20Y, 20M, and 20C).

Figure 6:
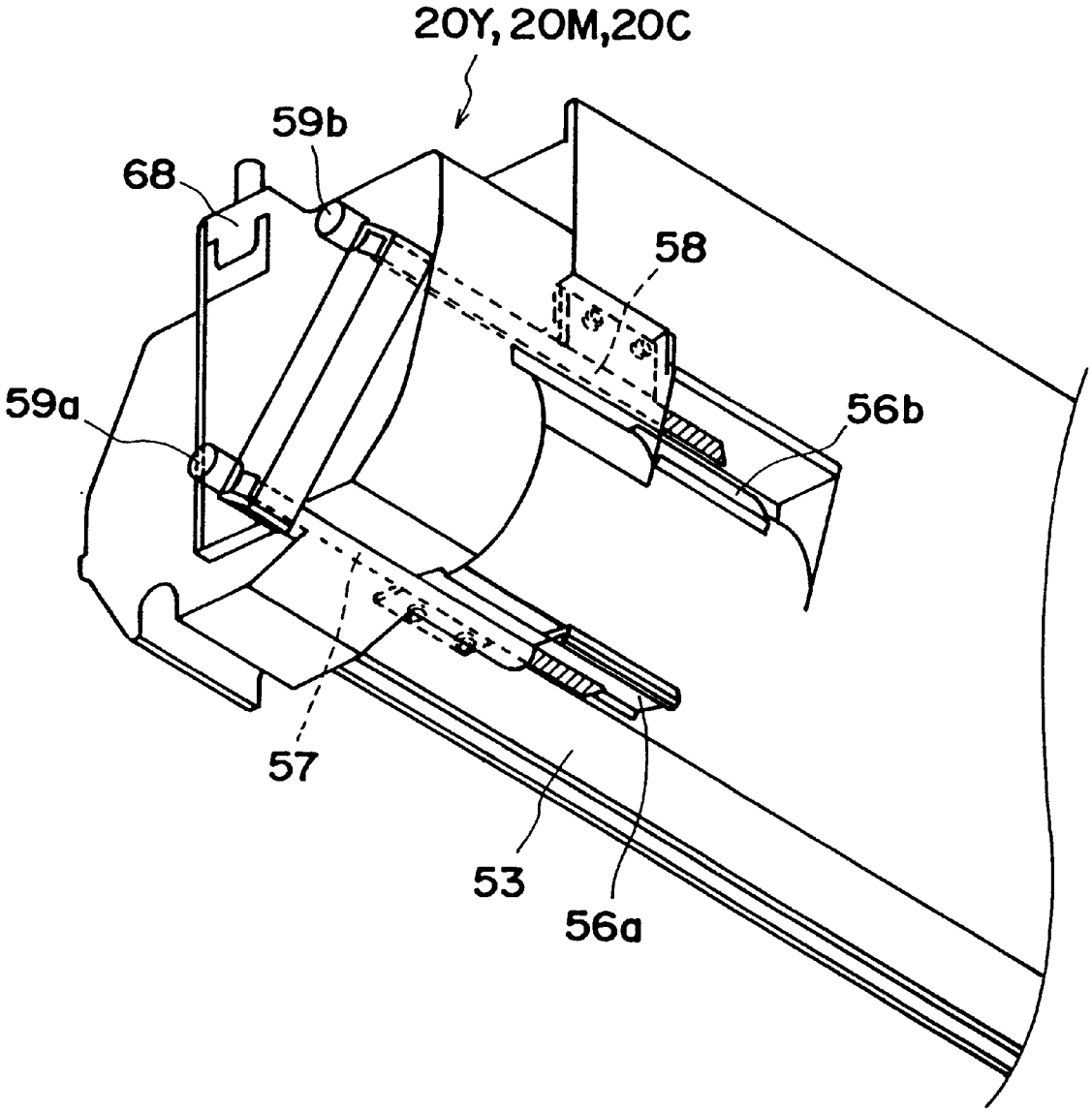
FIG. 6 is a perspective view of an essential portion of the rear corner of the developer container, as seen diagonally from inside of the container.

Referring to FIG. 6, the image forming apparatus main assembly 18 is provided with a light emitting member 59*a*. The toner detection light L ejected from the light emitting member 59*a* transmits through the light transmitting member 57 of the development cartridge, and passes through the transparent windows 56*a* and 56*b*. Then, the light L transmits through the transparent member of the development cartridge, and is received by an optical sensor 59*b*.

The light transmitting member 57 and 58 are disposed virtually in parallel to the longitudinal directions of a developing device (developing devices 20Y, 20M, and 20C). They are covered with the extensions 68*a* and 68*b*, one for one, of a rear cover 68 attached to the rear end, one of the longitudinal ends, of a development cartridge (developing devices 20Y, 20M, and 20C) with the use of screws, as shown in FIGS. 3 and 4. Therefore, the light transmitting members 57 and 58 are unlikely to be contaminated by toner, and also are prevented from being damaged due to the mishandling of a development cartridge.

The amount of the remaining toner in the developer container 53 is detected by measuring the transmittance of the detection light L through the developer container 53, while the toner within the developer container 53 is stirred by the rotation of the developer stirring member 62 (FIG. 3) disposed within the developer container 53.

Structure of Installation Guide for Development Cartridge (Chromatic Developing Device)

Figure 7:
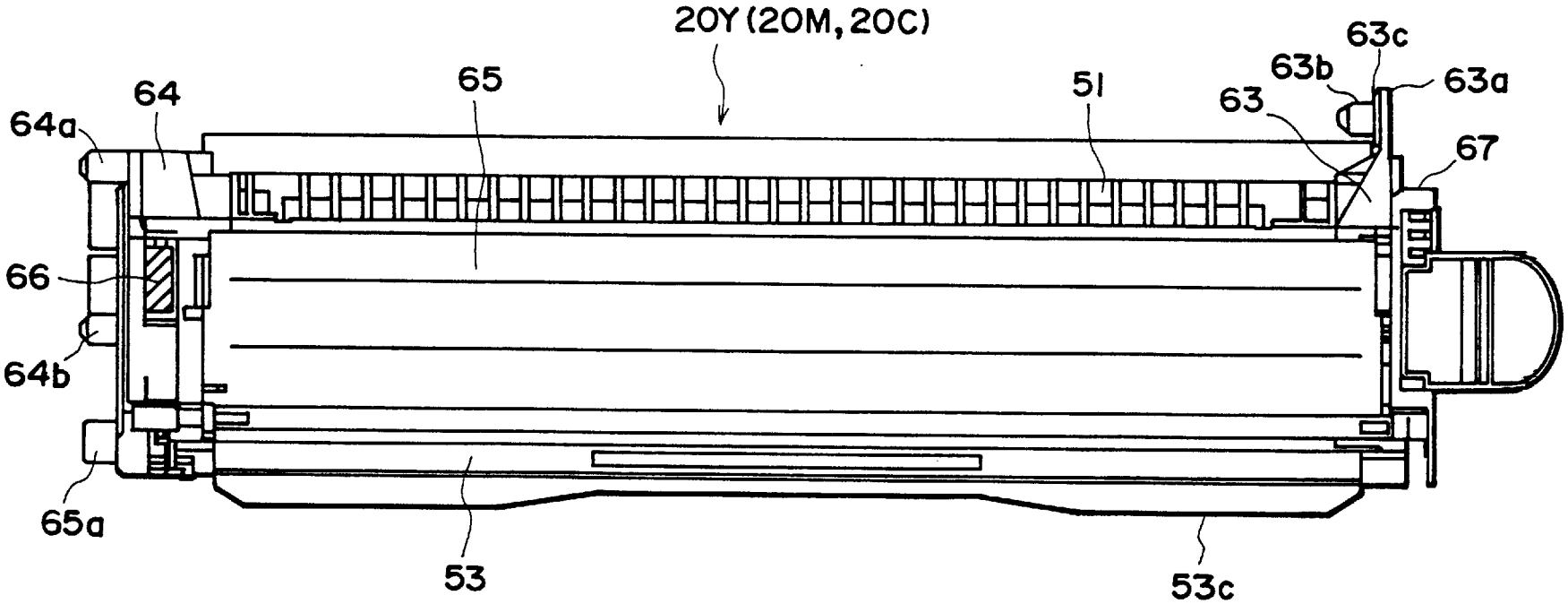
FIG. 7 is a top plan view of a development cartridge.
Figure 8:
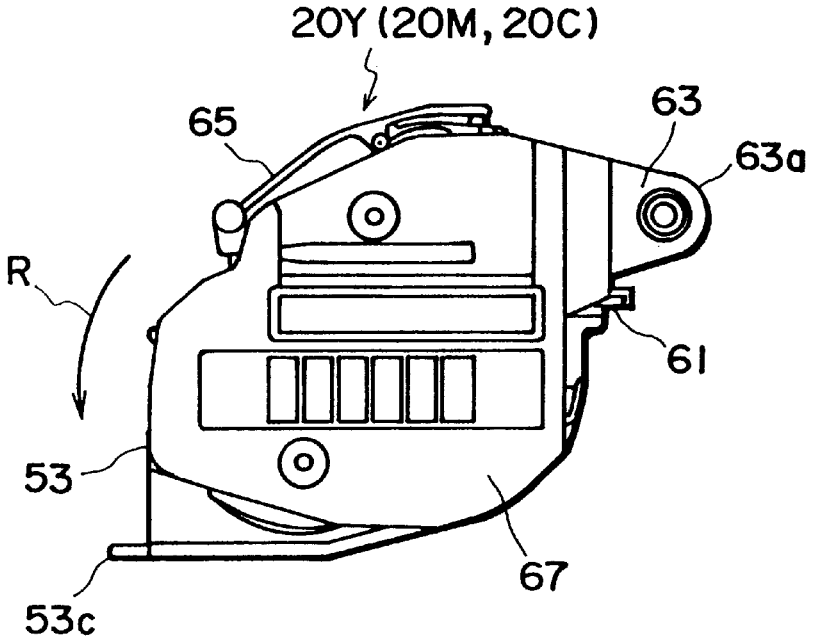
FIG. 8 is a front plan view of a development cartridge.
Figure 9:
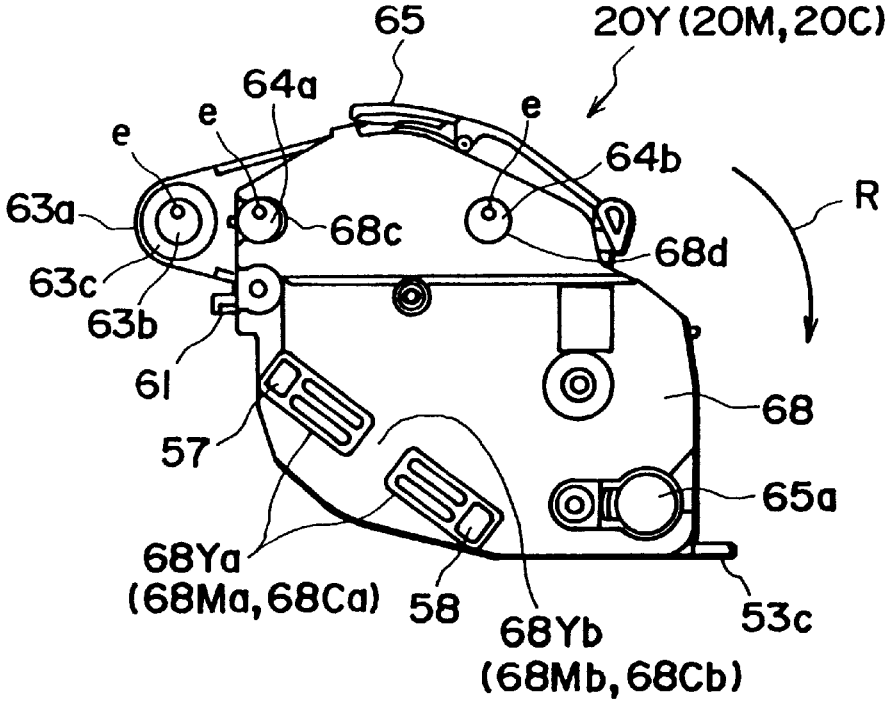
FIG. 9 is a rear plan view of a development cartridge.
Figure 10:
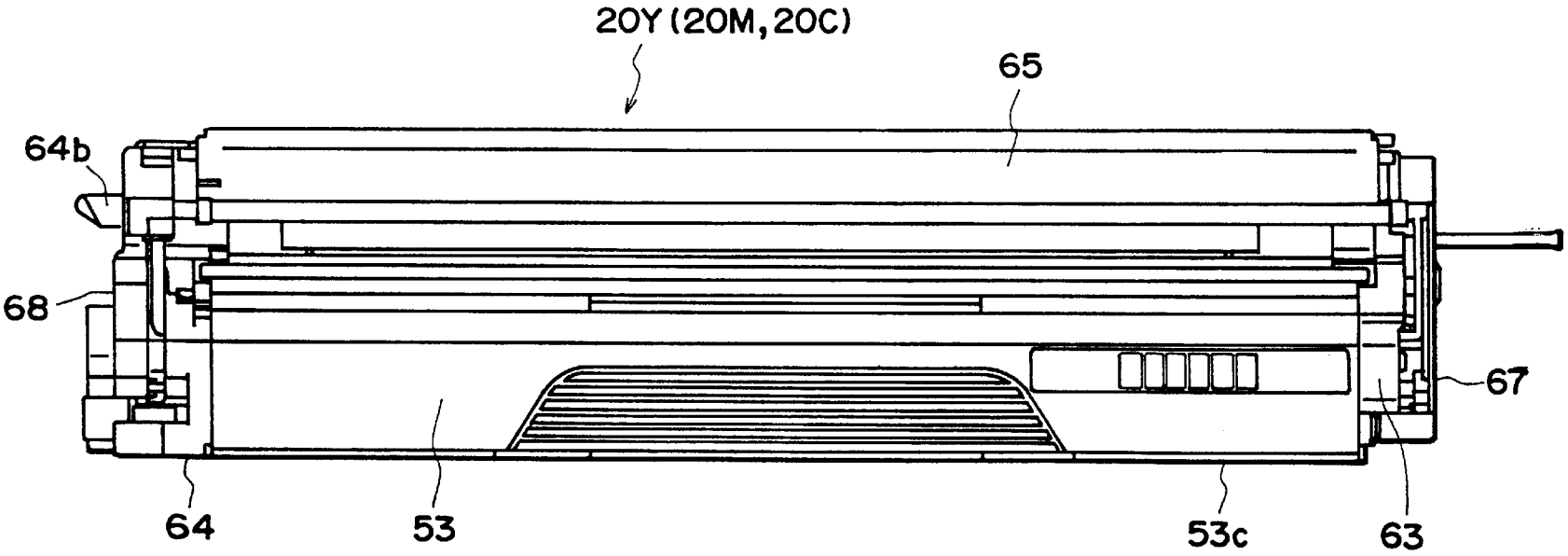
FIG. 10 is a plan view of the left side of a development cartridge.
Figure 11:
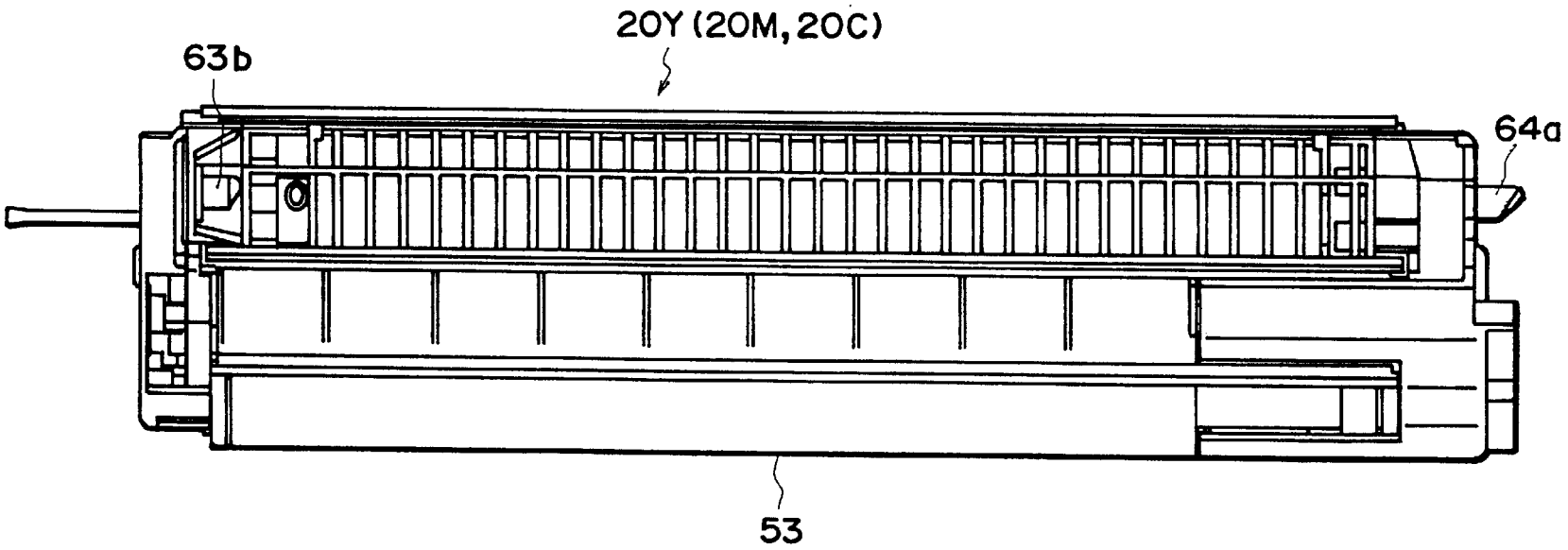
FIG. 11 is a plan view of the right side of a development cartridge.
Figure 12:
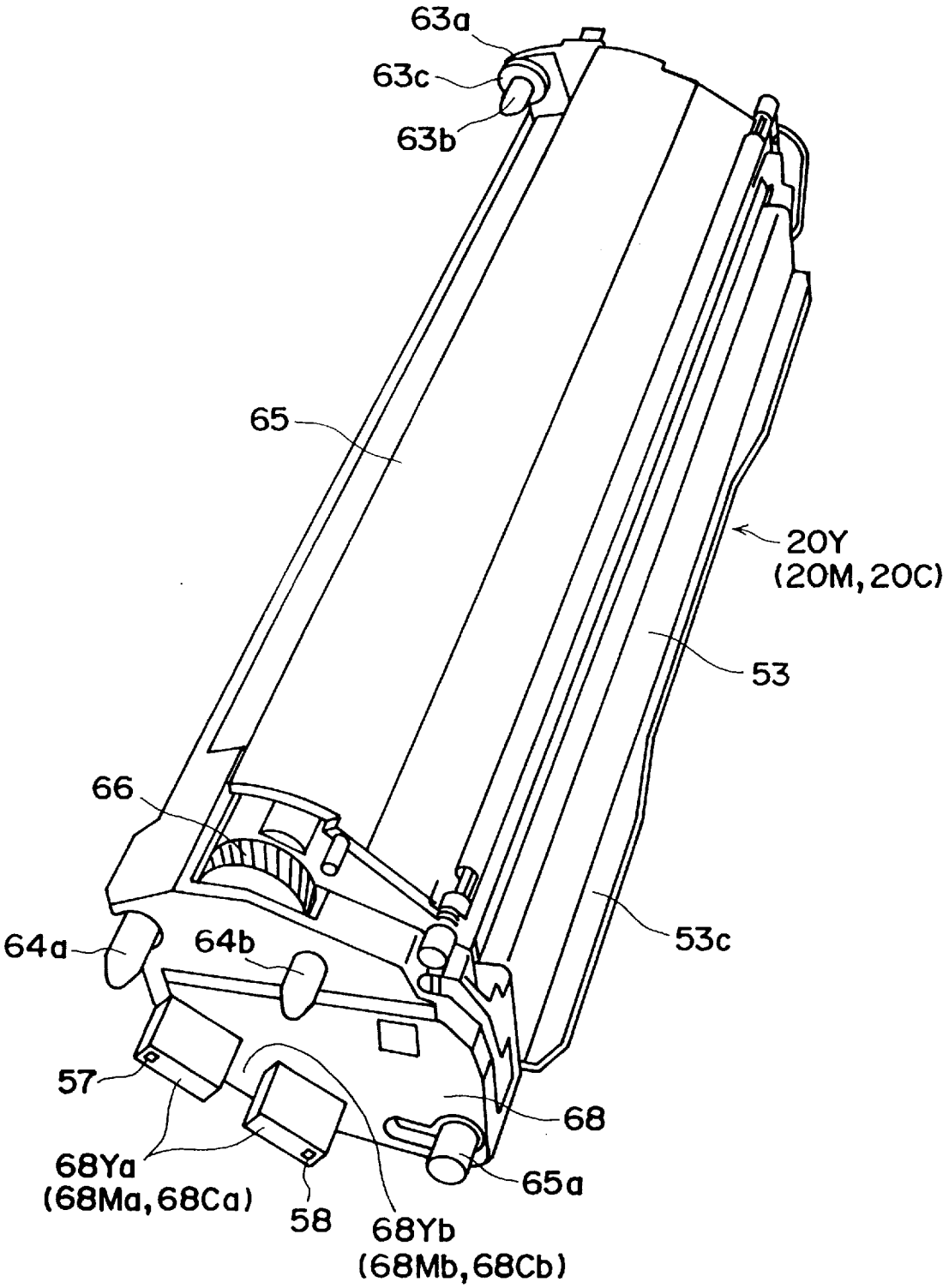
FIG. 12 is a perspective view of a development cartridge as seen from the rear and above.
Figure 13:
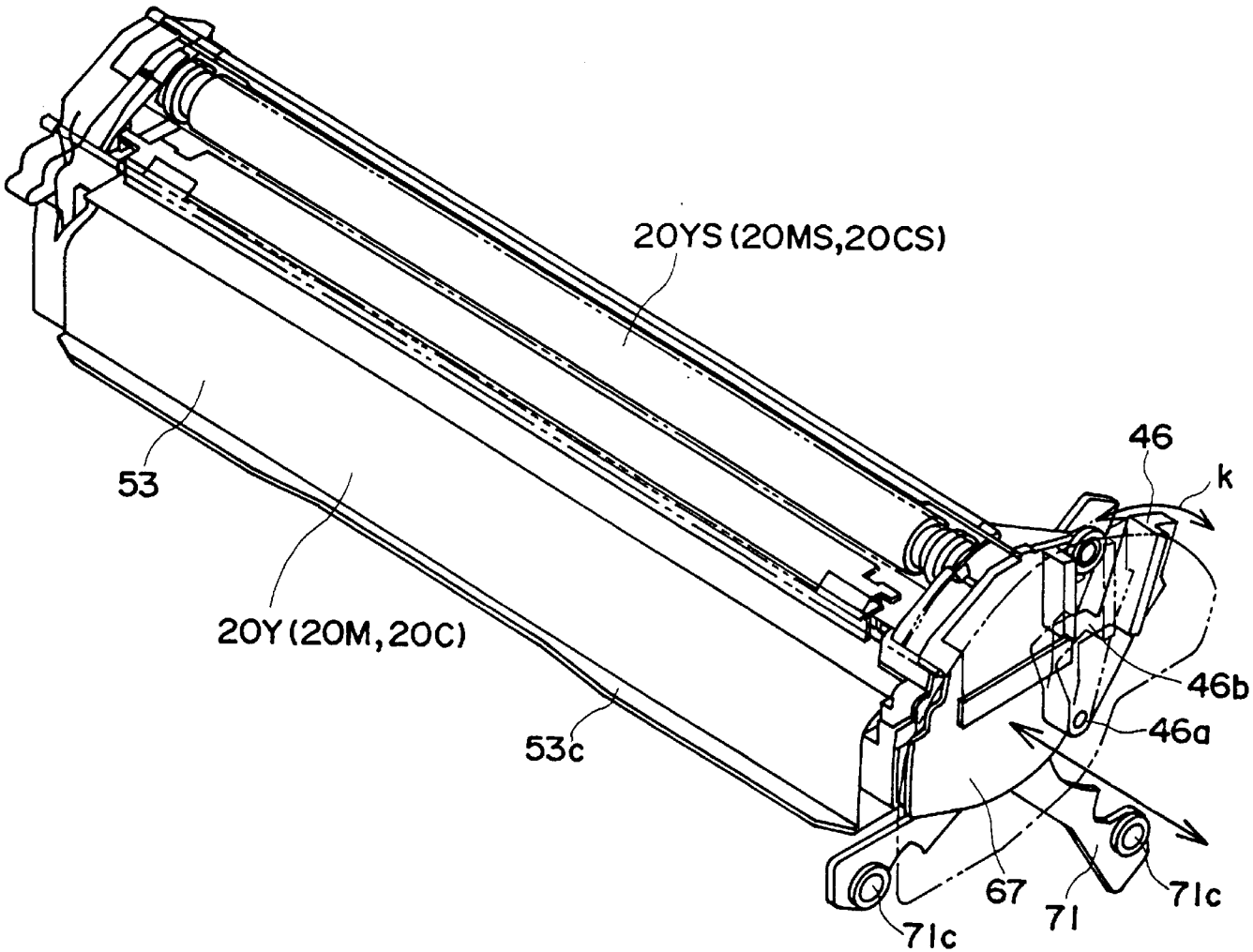
FIG. 13 is a perspective view of a development cartridge as seen from the front and above.
Figure 14:
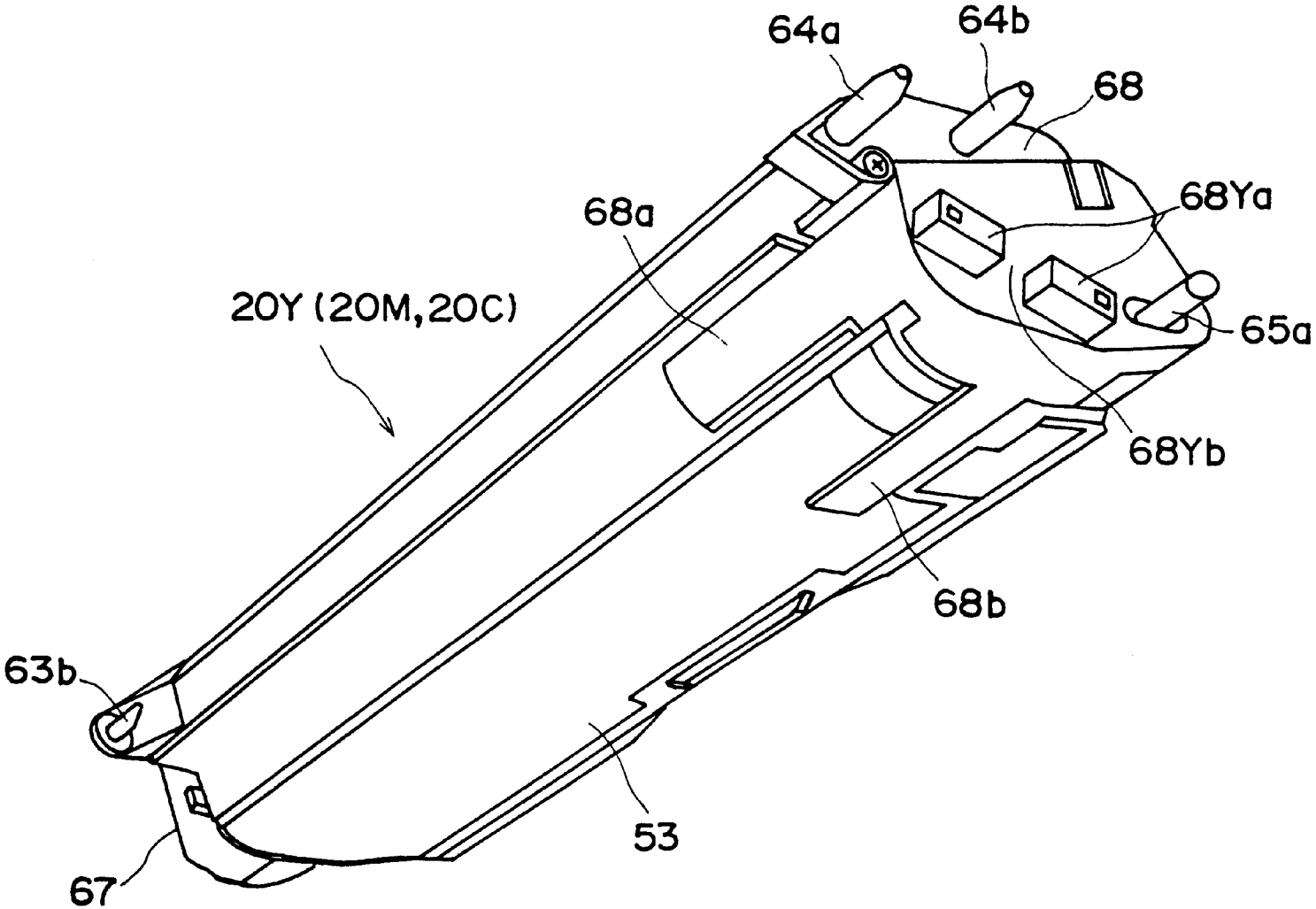
FIG. 14 is a perspective view of a development cartridge as seen from the rear and below.

First, the means for installing or removing a development cartridge will be described. Then, the structure, on the image forming apparatus main assembly side, for installing or removing a development cartridge will be described. FIGS. 7, 8, and 9 are top, front, and rear plan views, correspondingly, of a process cartridge. FIGS. 10 and 11 are left and right lateral plan views, respectively, of the process cartridge. FIGS. 12, 13, and 14 are perspective views of the process cartridge, as seen from the rear and above, the front and above, and the rear and below, correspondingly. Here, a development cartridge is described with reference to the development cartridge 20Y for yellow color. However, the structures of the development cartridges 20M and 20C for magenta and cyan color, respectively, are the same as that of the development cartridge 20Y except for the identification portion for preventing a positional installation error which will be described later.

At this time, the means for guiding the development cartridge 20Y will be described.

In FIG. 3, the covers or the like have been removed. In FIG. 3, the left side of the development cartridge is the side which becomes the bottom side when the development cartridge is exchanged. FIG. 8 is a front plan view of the development cartridge 20Y as seen from the same direction as FIG. 3. As shown in FIGS. 3 and 8, the developer container 53 is provided with a guide 53*c* which extends straight from its bottom wall, that is, the wall which comes to the bottom when the development cartridge is replaced. Referring to FIGS. 7, 12 and 13, the guide 53*c* also extends along substantially the entire length of the development cartridge. The distance the guide 53*c* extends from the bottom wall of the development cartridge 20Y is smaller across the middle section of the guide 53*c*. Referring to FIG. 8 which shows the rotational inclination of the development cartridge 20Y which is being installed or removed, the development cartridge 20Y is provided with a guide 61 which is located diagonally above the guide 53*c*, on the right, and constitutes the counterpart of the guide 53*c*. Both guides 53*c* and 61 are substantially horizontal when the development cartridge 20Y is installed or removed. Referring to FIG. 3, the guide 61 consists of one of the longitudinal portions of the flange 53*d* of the developer container 53, and one of the longitudinal portions of the flange 51*b* of the developing means housing 51 of the development cartridge 20Y. The distance the guide 61 extends from the development cartridge 20Y is uniform across substantially the entire length of the development cartridge 20Y.

Next, the covers will be described. The covers are the components which are fixed, one for one, to the longitudinal ends of the developer container 53 and developing means housing 51.

Referring to FIG. 7, a middle cover 63 is a cover which is fixed to one of the longitudinal ends of the developing means housing 51, that is, the longitudinal end of the developing means housing 51 on the side of the installer or user of the development cartridge 20Y to cover the open portion of the longitudinal end of the developing means housing 51 on the installer side. A middle cover 64 is the cover which is fixed to the other longitudinal end of the developing means housing 51, that is, the longitudinal end of the developing means housing 51 on the rear side as seen from the installer of the development cartridge 20Y, to cover the open portion of the longitudinal end of the developing means housing 51 on the rear side. The covers 62 and 64 are provided with a link (unillustrated) for supporting a shutter 65 which exposes or covers the opening of the development cartridge 20Y, through which the development roller 20YS (20MS, 20CS) is exposed. Also referring to FIG. 7, a referential character 66 designates a development roller gear which meshes with the driving gear (unillustrated) on the apparatus main assembly 18 side as the development cartridge 20Y is installed into the apparatus main assembly 18. The development roller gear 66, and a gear which meshes with the gear 66, are supported by the cover 64. The development roller 20YS (20MS and 20CS) and the toner coating roller 20YR (20MR and 20CR) are rotationally supported also by the covers 63 and 64. The development roller 20YS (20MS and 20CS), toner coating roller 20YR (20MR and 20CR), and developer stirring member 62 are driven by the aforementioned gear which is meshed with the development roller gear 66.

The shutter 65 is provided with an actuator 65*a* which comes in contact with the rear flange 81 (FIG. 16) of the development rotary 23 as the development cartridge 20Y is installed into the development rotary 23. More specifically, as the development cartridge 20Y is pushed into the development rotary 23, the actuator 65*a* is moved, relative to the development cartridge 20Y, in the direction opposite to the direction in which the development cartridge 20Y is pushed into the development rotary 23. In other words, the actuator 65*a* is pushed into the development cartridge 20Y. As the actuator 65*a* pushed into the development cartridge 20Y, it rotates the shutter in the direction indicated by an arrow mark R (FIGS. 8 and 9), through the link (unillustrated) which supports the shutter 65. As a result, the development roller 20YS is exposed. On the other hand, as the development cartridge 20Y is moved away from the rear flange 81 of the development rotary 23 to remove the development cartridge 20Y from the development rotary 23, the shutter 65 is closed by a spring (unillustrated), and the actuator 65*a* comes out of the development cartridge 20Y.

Front and rear covers 67 and 68 are fixed to the covers 63 and 64, respectively, with the use of screws. Referring to FIG. 14, the rear cover 68 is provided with a pair of extensions 68*a* and 68*b* which extend along the bottom side of the developer container 53 to cover the lateral surfaces of the light transmitting members 57 and 58. The extensions 68*a* and 68*b* are integral parts of the single piece rear cover 68.

Referring to FIGS. 7, 8, 9, and 12, the cover 63 is provided with a bracket 63*a*, which is an integral part of the cover 63 and projects from the developing means housing 51 beyond the contour of the developing means housing 51 in the width direction of the development cartridge 20Y. The bracket 63*a* is provided with a front positioning pin 63*b* which projects from the bracket 63*a* in the direction in which the development cartridge 20Y is inserted. There is a seat 63*c* at the base of the pin 63*b*. The pin 63*b* is cylindrical and extends parallel to the longitudinal direction of the development roller 20YS (20MS and 20CS). The imaginary extension of the axial center line of the cylindrical pin 63*b* is on the outward side of the contours of the developing means housing 51, the cover 64, and the cover 68.

Referring to FIG. 9, the cover 64 integrally comprises rear positioning pins 64*a* and 64*b* which project rearward in parallel to the pin 63*b*. They are identical to the front positioning pin 63*b* in terms of the distance from the center line of a positioning pin to the base of a bracket for the positioning pin. They are parallel to the development roller 20YS (20MS and 20CS). The positioning pins 63*b*, 64*a*, and 64*b* are all tapered so that they become smaller toward their tips, and so that when the development cartridge 20Y is out of the apparatus main assembly 18, the tips e of the positioning pins 63*b*, 64*a*, and 64*b* are positioned slightly above the center lines of the positioning pins 63*b*, 64*a*, and 64*b*, correspondingly. A portion 68*c* of the rear cover 68 has been removed to prevent it from interfering with the pin 64*a*. Also the rear cover 68 is provided with a round hole 68*d* so that the rear cover 68 does not interfere with the pin 64*b*.

The development cartridges 20Y, 20M and 20C are provided with an identification mark, that is, an indentation, the location of which corresponds to the type or color of the toner in a development cartridge.

More specifically, each development cartridge is provided with a long ridge with an indentation, and the location of the identification is varied according to the development cartridge identity. Therefore, all that is necessary to prevent a development cartridge from being installed into the wrong slot of the development rotary 23 is to provide each slot with a rib which fits in the indentation of the correct development cartridge.

Figure 15:
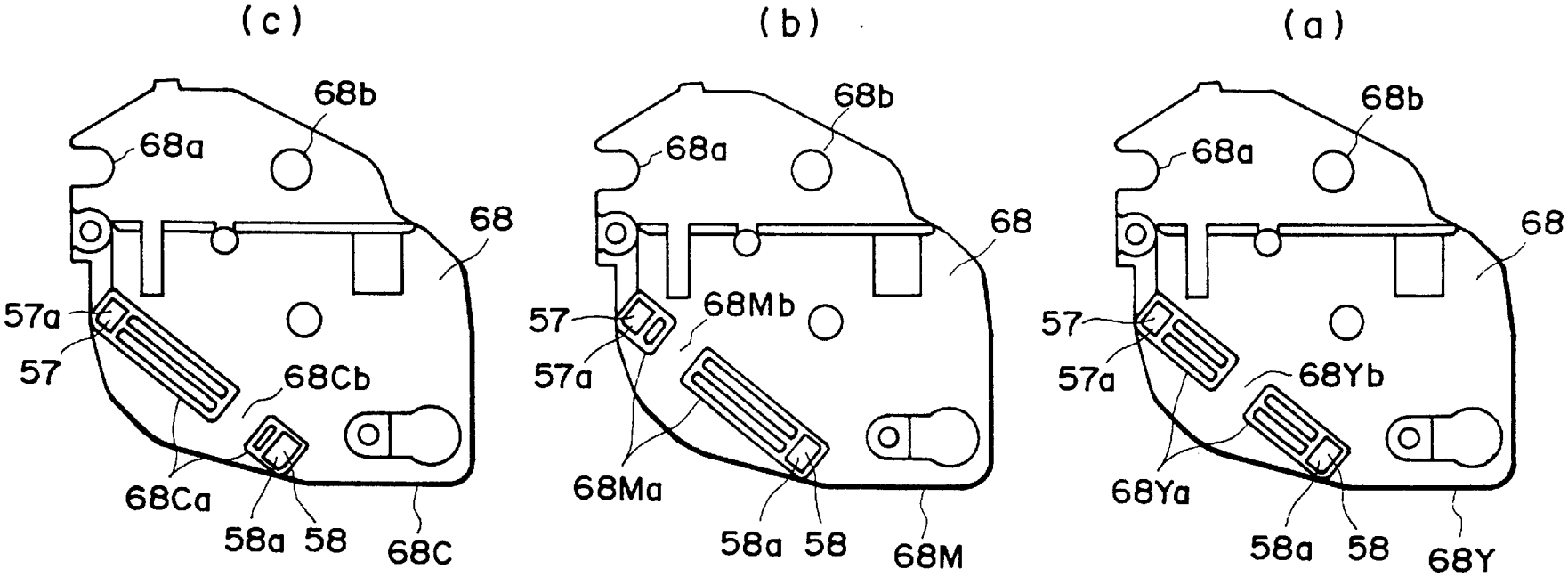
FIG. 15, (*a, b*, and *c*), are rear plan views of the rear cover of a development cartridge as seen from the rear of the development cartridge.

FIG. 15 is a plan view of the outward (back) side of the rear cover 68. FIG. 15, (*a*) represents the rear cover 68Y for the development cartridge 20Y for yellow color; FIG. 15, (*b*), the rear cover 68M for the development cartridge 20M for magenta color; and FIG. 15, (*c*) represents the rear cover 68C for the development cartridge 20C for cyan color. The rear covers 68Y, 68M, and 68C are provided with projections 68Ya, 68Ma, and 68Ca for identifying the development cartridges 20Y, 20M, and 20C, correspondingly. The projection is an integral part of the rear cover 68, and is formed of synthetic resin.

The projection 68Ya is positioned away from the development roller 20YS, as are the projections 68Ma and 68Ca from the development rollers 20MS and 20CS, respectively. The projection 68Ya is in the form of a long and narrow rectangle, and projects from the rear cover 68Y in the direction in which the development cartridge 20Y is inserted into the development rotary 23. The projections 68Ma and 68Ca are also in the form of a long and narrow rectangle, and project from the rear covers 68M and 68C in the direction in which the development cartridges 20M and 20C are inserted into the development cartridge slots 23M and 23C, respectively. Actually, the projections 68Ya, 68Ma, and 68Ca consist of two sections which are separated by an indentation (groove). The projection is on the downstream side of a development cartridge, in terms of the direction in which a development cartridge is inserted. The end surface of the projection is perpendicular to the direction in which a development cartridge is inserted. The projections 68Ya, 68Ma, and 68Ca are identical in terms of their positions relative to the rear covers 68Y, 68M, and 68C, correspondingly. They are also identical in shape and measurement. However, they are different in terms of the location of the indentation (groove) between the two portions of the projection. In other words, if the rear covers 68Y, 68M, and 68C are stacked so that projections 68Ya, 68Ma, and 68Ca align, the recesses 68Yb, 68Mb, and 68Cb do not align. The development cartridges 20Y, 20M and 20C are pivotable so that they can be placed in contact with, or separated from, the photosensitive drum 15. The recesses 68Yb, 68Mb, and 68Cb do not align even if the pivoting of a development cartridge is taken into consideration.

Referring to FIG. 15, the outward ends 57*a* and 58*a* (light entrance end and light exit end, respectively) of the aforementioned light transmitting members 57 and 58 are slightly recessed compared to the end surfaces of the projections 68Ya, 68Ma, and 68Ca, but are exposed. The outward ends 57*a* and 58*a* of the light transmitting members 57 and 58, respectively, of each process cartridge are surrounded by the correspondent projections 68Ya, 68Ma, and 68Ca, and therefore, they are not damaged. As is evident from the above description, the apparatus main assembly and the process cartridge are structured so that the former and the process cartridge identifying section of the latter loosely fit each other. Therefore, the process cartridge identifying section does not interfere with the structure for pressing a development member upon, or moving it away from, the electrophotographic photosensitive drum.

[Means for Installing Development Cartridge into Main Assembly of Image Forming Apparatus]

As described previously, the apparatus main assembly 18 is provided with the development rotary 23 as a means for installing the development cartridge 20Y (20M and 20C). The development rotary 23 is provided with a means for guiding the development cartridge 20Y (20M and 20C) during the installation or removal of the development cartridge 20Y (20M and 20C), and a means for properly positioning the development cartridge 20Y (20M and 20C) as the development cartridge is installed.

Figure 16:
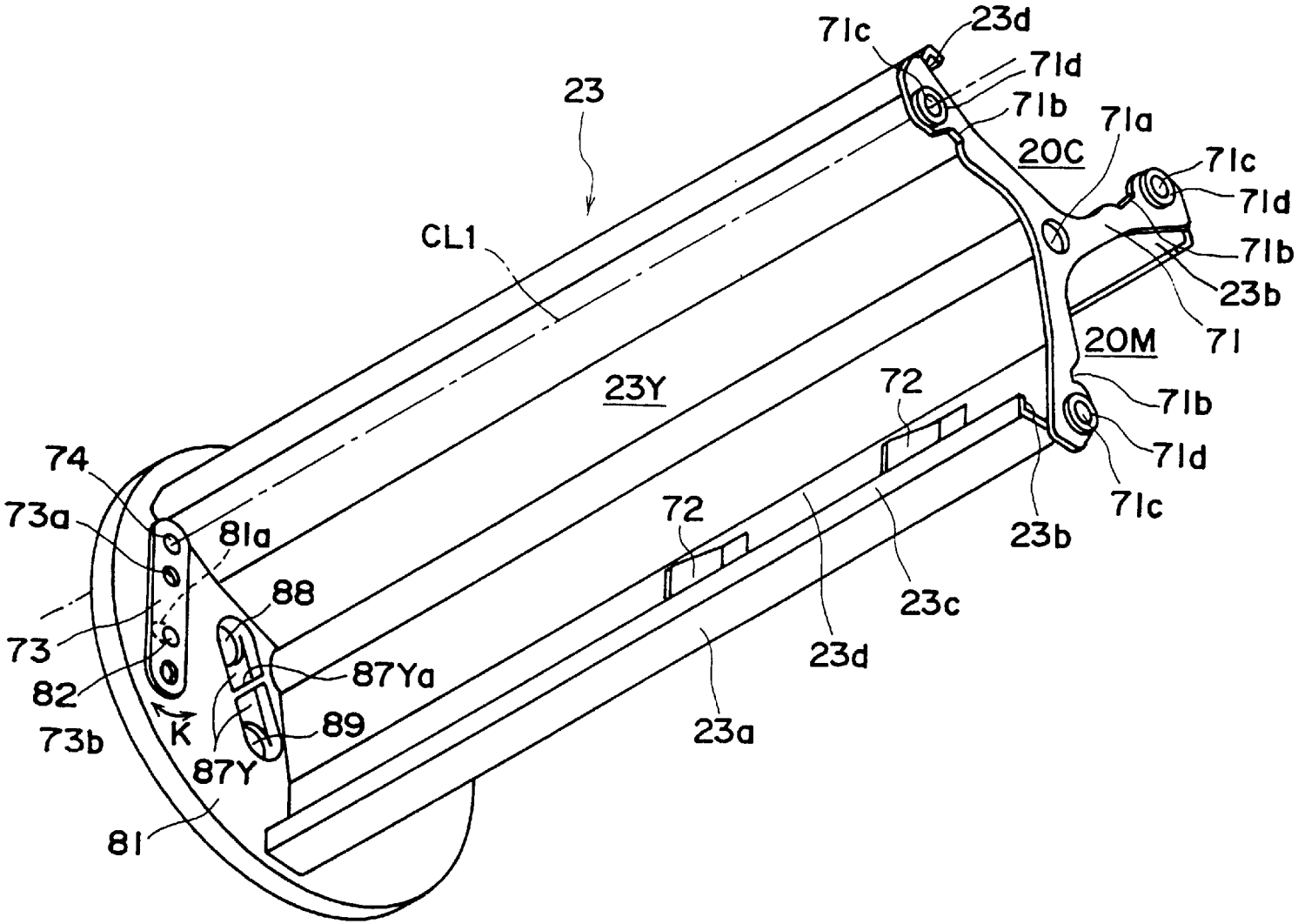
FIG. 16 is a perspective view of a development rotary.

Referring to FIG. 16, the development rotary 23 consists of a stay 23*a*, the main assembly, a front stay 71, and a flange 81. The front stay 71 is fixed to one of the longitudinal ends of the main stay 23*a*, and the flange 81 is fixed to the other longitudinal end. The front stay 71 is provided with a center hole 71*a* so that the front stay 71 can be rotationally supported by a center shaft 22 fixed to the apparatus main assembly 18. The main stay 23*a* is provided with a guiding groove 23*b*.

Each guide groove 23*b* is fitted with a pair of plate springs 72. The tip (free end) of the plate spring 72 is placed in contact with a rib 23*c* located at the top edge of the groove 23*b*, and the bottom end of the plate spring 72 is fixed to the divider wall 23*d* which faces the edge rib 23*c* across the groove 23*b*.

Figure 18:
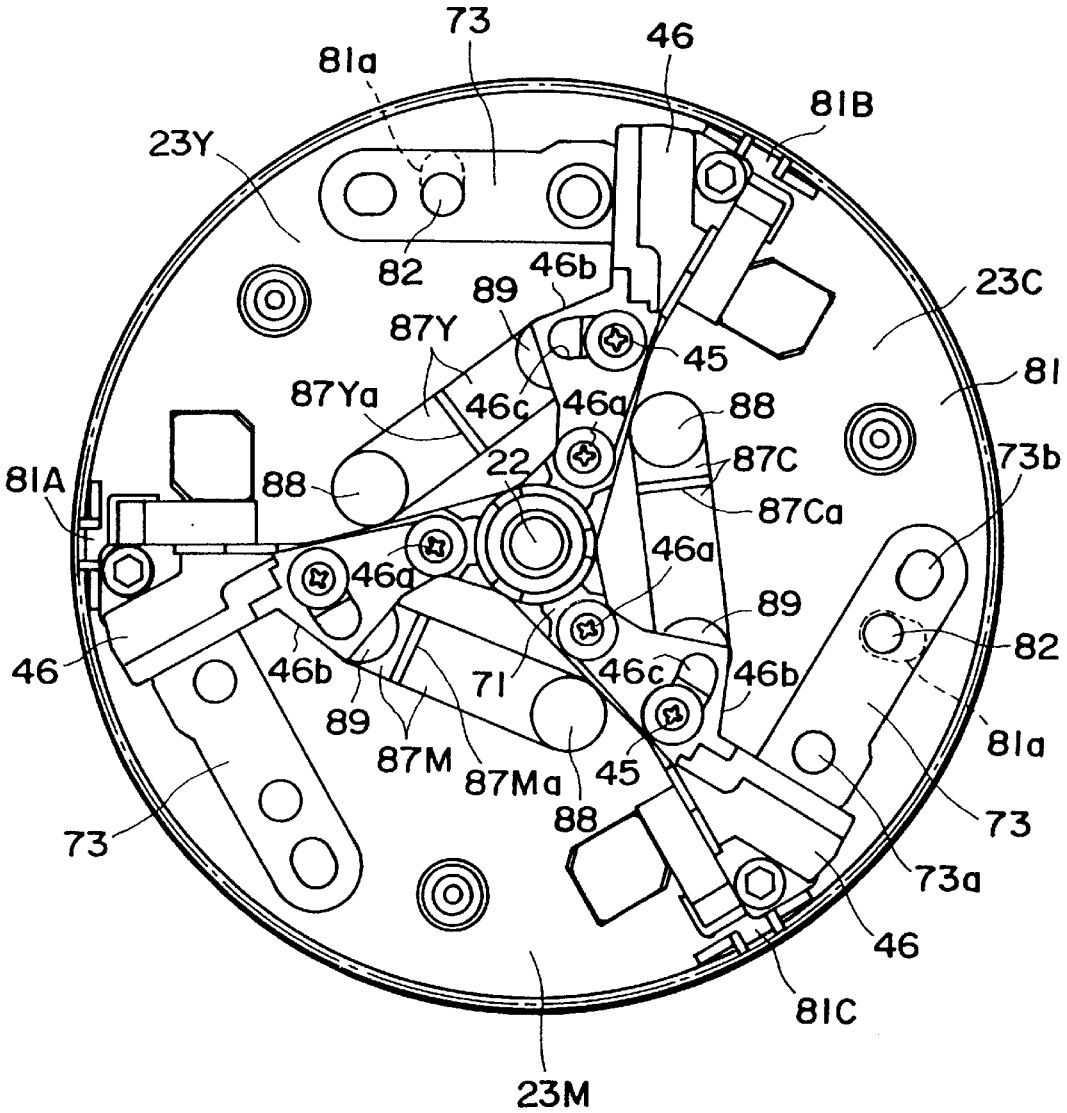
FIG. 18 is a front plan view of a development rotary.
Figure 19:
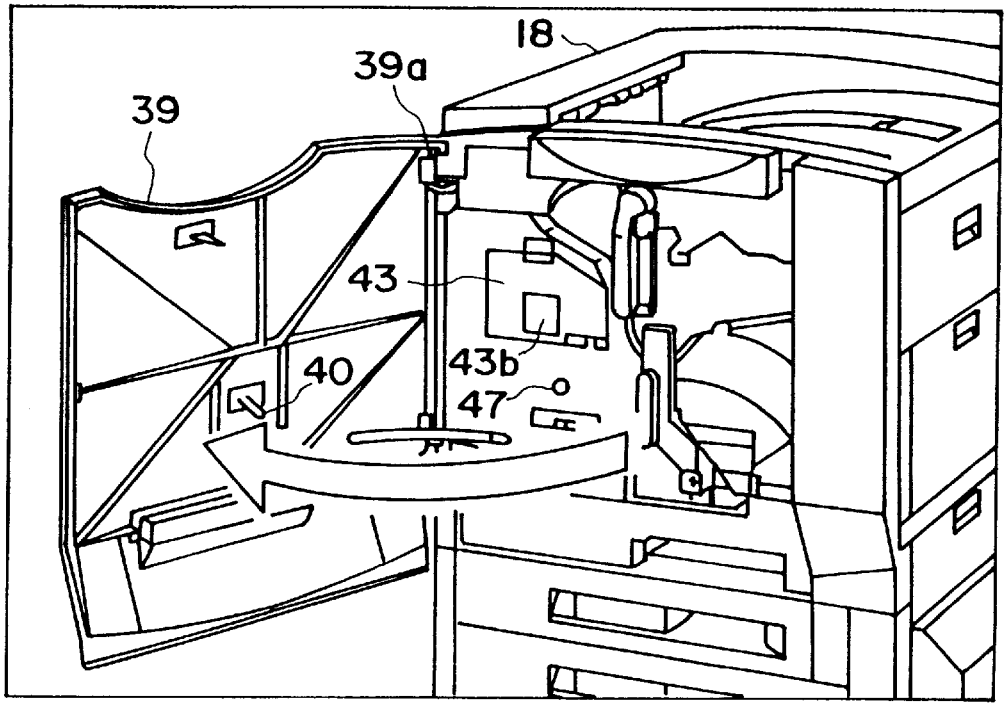
FIG. 19 is a perspective view of an electrophotographic image forming apparatus, the front door of which is open.
Figure 20:
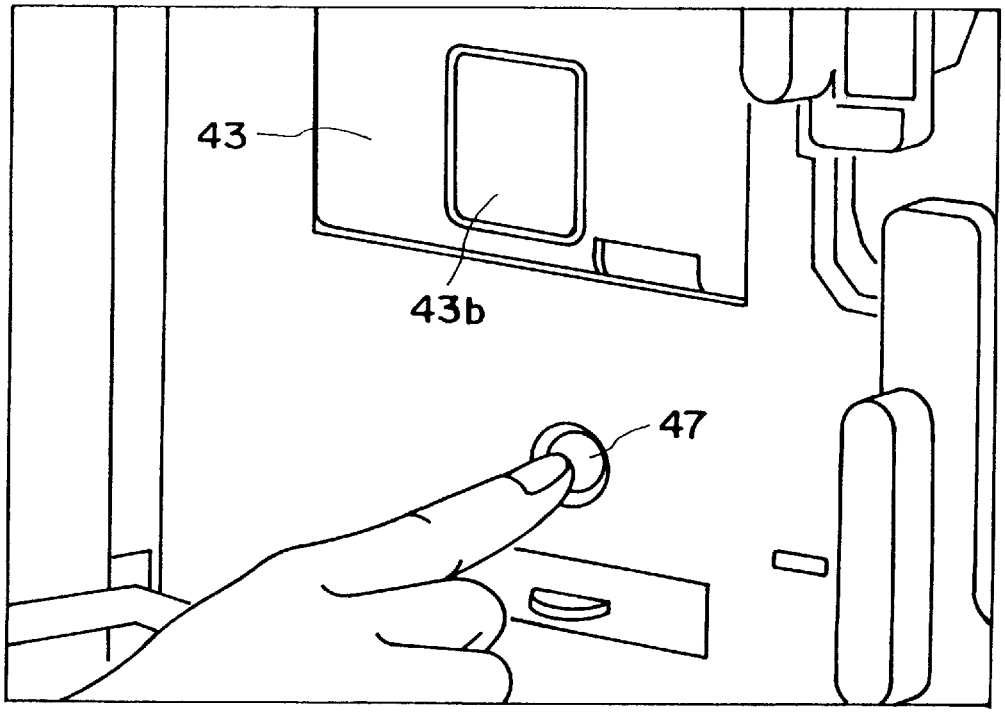
FIG. 20 is an enlarged view of a portion of the image forming apparatus in FIG. 19.

The size of the divider wall 23*d* of the development rotary 23 is such that as the development rotary 23 is seen from the front, the divider wall 23*d* cannot be seen; it is blocked by the front stay 71. In other words, the diameter of the circumcircle of the front stay 71 substantially coincides with the circumcircle of the main stay 23*a*. The three spaces created by the divider wall 23*d* constitute the development cartridge slots 23Y, 23M, and 23C (FIG. 18).

The flange 81 is fixed to the rear end of the main stay 23*a*. It is provided with a hole, which is located at the center of the flange 81, so that the development rotary 23 can be rotationally supported by the aforementioned center shaft 22. This center hole has the same diameter as the center hole 71*a* of the front stay 71. The diameter of the center hole 23*e* (FIG. 17) of the main stay 23*a* is the same as, or slightly larger than, that of the center hole 71*a* of the front stay 71.

The front stay 71 is provided with three grooves 71*b* (notches), one for each of its three arm portions, which align, one for one, with the guiding grooves 23*b* of the corresponding development cartridge slots 23Y, 23M, and 23C. Further, the development rotary 23 is provided with a cover (unillustrated) which extends in the longitudinal direction of the main stay 23*a* and is fixed to the main stay 23*a*.

The cartridge identifying portion is a member which projects outward from the downstream end of the development cartridge, in terms of the development cartridge installation direction. Therefore, it does not affect the operation for installing or removing the development cartridge. In other words, the process cartridge in accordance with the present invention is easy to install or remove.

The two light transmitting members as the optical means for detecting the amount of the toner in the process cartridge are disposed in parallel to the longitudinal direction of the development cartridge, and the light entrance and light exit of the light transmitting member are surrounded by the projection, while being exposed through the opening of the projection. This arrangement simplifies the rear end shape of the process cartridge, and yet prevents the light transmitting members from coming in contact with foreign objects, in other words, the light transmitting members are protected by the projection.

When the development cartridge 20Y (20M or 20C) is installed into, or removed from, the development rotary 23, it is guided by the guiding groove 23*b* of the development rotary 23, with the guide 53*c* of the cartridge loosely fitting in the groove, and the bottom surface of the developer container 53 sliding on the divider wall 23*d* of the mains stay 23*a* in the longitudinal direction of the development rotary 23. Further, the guide 61 which was described with reference to FIG. 3 loosely fits with the guiding groove 71*b* of the front stay 71, and the cover (unillustrated) fixed to the main stay 23*a*. With the above described arrangement, the development cartridge 20Y (20M and 20C) is prevented from moving right or left, that is, in the direction perpendicular to the longitudinal direction of the development cartridge when the development cartridge is installed into, or removed from, the development rotary 23.

Further, the front stay 71 is provided with a positioning hole 71*c* into which a pin 63*b* fits. The positioning hole 71*c* is in the end portion of each of the three arm portions of the front stay 71. The base portion of a pivotal arm 73 is pivotally supported by a pin shaft 74, the longitudinal axis of which coincides with a line CL1 which runs through the center of the positioning hole 71*c* and is parallel to the center shaft 22. The pivotal arm 73 is provided with positioning holes 73*a* and 73*b* which engage with the pins 64*a* and 64*b* of the development cartridge 20Y (20M and 20C), which are on the rear side in terms of the cartridge installation direction. The positioning hole 73*b* is the hole elongated in the longitudinal direction of the pivotal arm 73. The positioning hole 73*a* is the hole which engages with the pin 64*a* located on the rear end surface of the development cartridge 20Y (20M and 20C). The flange 81 is provided with a hole 81*a* (FIG. 18) elongated in the direction substantially perpendicular to the longitudinal direction of the pivotal arm 73. The pivotal range of the pivotal arm 73 is regulated by a pin 82.

Referring to FIG. 13, the front stay 71 is engaged with a release lever 46 with the use of a pin (shaft) 46*a*. The release lever, which is pivotable in the direction indicated by an arrow mark K, can take two positions: a position at which the lever does not prevent the development cartridge 20Y (20M and 20C) from being installed into, or removed from, the development rotary 23 in the direction indicated by an arrow mark m, and a position at which the level prevents the development cartridge 20Y (20M and 20C) from being removed from the development rotary 23 after the installation of the development cartridge 20Y (20M and 20C) into the development rotary 23. Referring to FIG. 18, in order to regulate the above described pivotal movement of the release lever 46, the release lever 46 is provided with an elongated hole 46*c*, and a screw 45 is screwed into the front stay 71 through this elongated hole 46*c*. Further, the release lever 46 is provided with a shoulder-like portion 46*b*, on which the guide 61 can rides.

Also referring to FIG. 18, the flange 81 is provided with recesses 87Y, 87M, and 87C, as the development cartridge identifying portions, which correspond to the carriage slots 23Y, 23M, and 23C.

The recesses 87Y, 87M, and 87C (recesses on main assembly side) are elongated recesses which extend in the direction perpendicular to the center shaft 22. They are located close to the center shaft 22, each one the same distance from the center shaft 22. The aforementioned development cartridge identifying projections 68Ya, 68Ma, and 68Ca (projections on cartridge side) loosely engage with the corresponding recesses 87Y, 87M, and 87C. In other words, the main assembly is provided with ribs 87Ya, 87Ma, and 87Ca (projections on main assembly side) which engage with the corresponding recesses 68Yb, 68Mb, and 68Cb (recesses on cartridge side) with which the corresponding projections 68Ya, 68Ma, 68Ca (projections on cartridge side) are provided. The recesses 87Y, 87M, and 87C loosely engage with the corresponding projections 68Ya, 68Ma, and 68Ca, so that the development cartridge 20Y (20M and 20C) is allowed to pivot about the pin 63*b* and pin (shaft) 74 after the development cartridge is installed into the development rotary 23. If the development cartridge is installed into the wrong slot, that is, a slot into which the development cartridge should not be installed, the recesses 68Yb, 68Mb, and 68Cb cannot engage with the corresponding ribs 87Ya, 87Ma, and 87Ca. More specifically, even though the process cartridges 20Y, 20M, and 20C can be inserted into the development rotary 23 until the projections 68Ya, 68Ma, and 68Ca make initial contact with the corresponding ribs 87Ya, 87Ma, 87Ca, they cannot be inserted further. Therefore, the development cartridge can be prevented from being installed into the wrong slot. In addition, the type of the development cartridge can be easily identified by a simple method, that is, varying the position of the rib which divides the long and narrow recess.

The bottom of each recess (87Y, 87M, and 87C) is provided with through holes 88 and 89 through which the light transmitting members 57 and 58, respectively, are exposed.

The provision of the through holes 88 and 89 in the development cartridge identifying recess on the apparatus main assembly side simplifies the main assembly structure compared to another design, according to which the development cartridge identifying portion and the light transmitting openings are separately provided.

Also, the provision of the through holes 88 and 89 in the longitudinal ends, one for one, of the development cartridge identifying recess on the main assembly side make it possible to make the development cartridge identifying portion sufficiently long, and also makes it unnecessary to provide the main assembly with through holes dedicated for light transmission, simplifying the means for installing the development cartridge.

Figure 17:
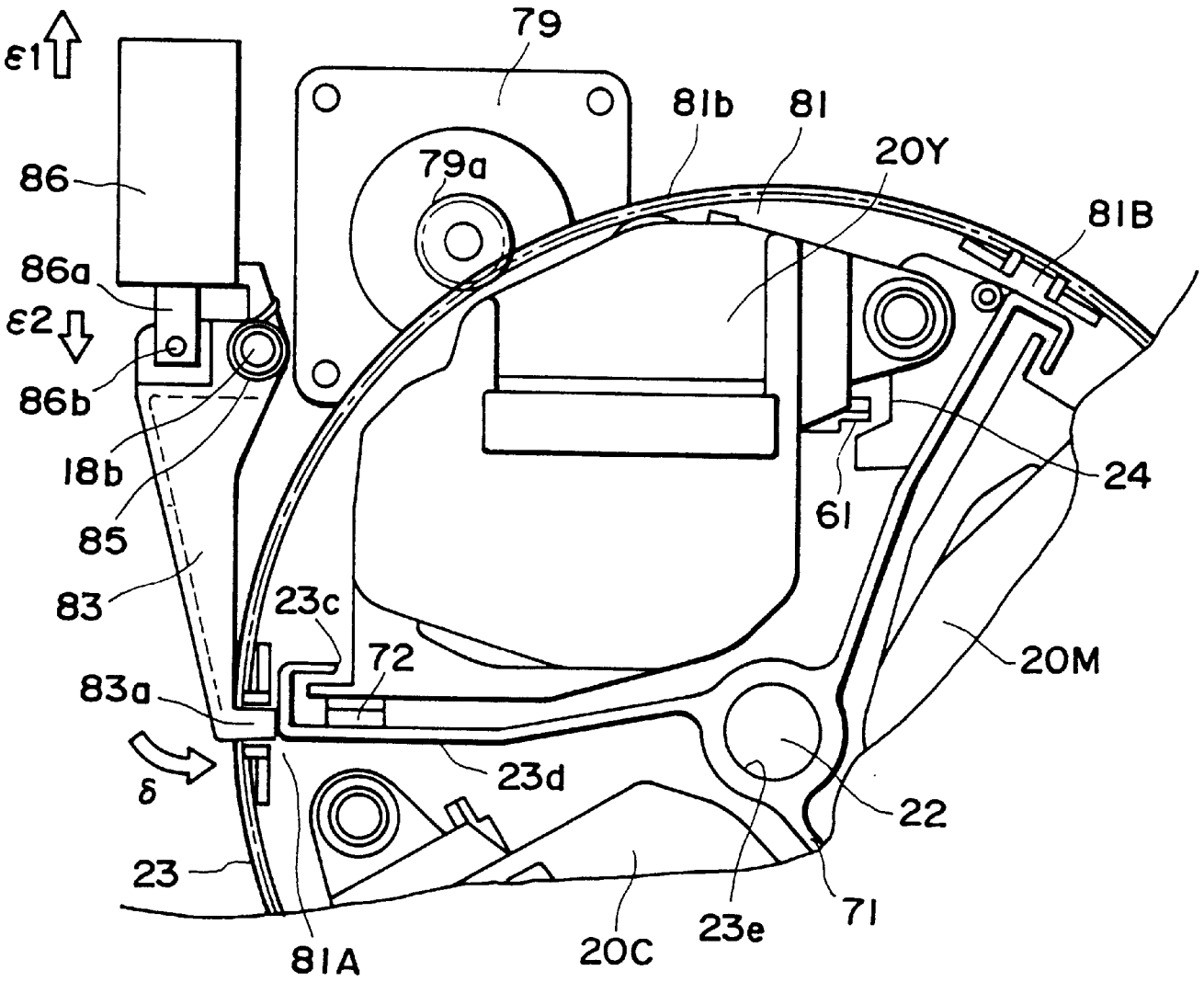
FIG. 17 is a rear plan view of the partially cut-out development rotary.

Next, the rotation of the development rotary 23 will be described. Referring to FIG. 17, the flange 81 is provided with a gear 81*b*, which is fitted around the periphery of the flange 81. The gear 81*b* is meshed with a small gear 79*a* fixed to the shaft of a motor 79 mounted in the apparatus main assembly 18. Thus, the development rotary 23 is rotated by the driving force from the motor 79. The back side of the flange 81 is provided with a flag for detecting the position (rotational direction) of the development rotary 23. As the development rotary 23 is rotated, the position of the flag is detected by a photo-interrupter (unillustrated) to control the rotation of the development rotary 23. More specifically, as a rotary rotation button 47, which will be described later, is pressed, the development rotary 23 is rotated by the driving force from the motor 79 while the number of degrees the development rotary 23 was rotated is determined by the detected position of the flag of the flange 81. The development rotary 23 is rotated until the development cartridge 20Y (20M and 20C) reaches a predetermined position (FIG. 17) at which the development cartridge can be replaced. As the development cartridge 20Y (20M and 20C) reaches this position, the actuator 83 is triggered; in other words, the stopper portion 83*a* of the actuator 83 fits into the slit 81A (81B and 81C), locking the development rotary 23 so that the development cartridge 20Y (20M and 20C) can be exchanged.

Next, referring to FIG. 17, the means for supporting the development rotary 23 will be described. In FIG. 17, the stopper portion 83*a* is in engagement with the slit 81A, locking the development rotary 23 so that the development cartridge 20Y can be exchanged. The development rotary 23 is holding three development cartridges 20Y, 20M, and 20C, and the development cartridge 20Y is to be exchanged. The means for locking the development rotary 23 consists of a solenoid 86, an actuator 83, and a torsional coil spring 85

(pressure generating means). The actuator 83 is rotationally supported by a nonrotational shaft 18*b* fixed to the apparatus main assembly 18, and is connected to the steel core (movable shaft) of a solenoid 86 by a pin 86*b*. The solenoid 86 is kept under the pressure generated by the coil spring 85 to press the stopper portion 83*a* of the actuator 83 in the direction indicated by an arrow mark δ in FIG. 6.

The solenoid 86 is of a keep-type. Thus, the steel core 86*a* can be moved in both directions indicated by arrow marks ϵ1 and ϵ2 by changing the current direction. When current is not flowing through the solenoid 86, the steel core 86*a* is pulled into the solenoid 86 and kept there by a permanent magnet, which is disposed in the solenoid and constantly pulls the steel core 86*a* in the direction indicated by the arrow mark ϵ1.

The actuator 83 is in the shape of a bell crank. One end of the actuator forms the stopper portion 83*a*, and the other end is provided with an elongated hole (unillustrated), in which the steel core 86*a* of the solenoid 86 is fitted. The actuator 83 is enabled to be pivoted about the nonrotational shaft 18*b*. Thus, as the steel core 86*a* of the solenoid 86 moves in the direction indicated by the arrow mark ϵ1 in the drawing, the actuator 83 rotates in the direction opposite to the direction indicated by the arrow mark δ, whereas as the steel core 86*a* moves in the direction indicated by the arrow mark ϵ2, the actuator 83 moves in the direction indicated by the arrow mark δ.

Further, as described above, the actuator 83 is engaged with the torsional coil spring 85 which pressures the actuator 83 to rotate in the direction indicated by the arrow mark δ. One end of the torsional coil spring 85 is fixed to the nonrotational shaft 18*b*, and the other end is anchored to the actuator 83. The force generated by the torsional coil spring 85 is such force that works in the direction to pull the steel core 86*a* out of the solenoid 86. As described above, a permanent magnet is contained in the solenoid 86. Therefore, the steel core 86*a* is continuously subjected to the force which works in the direction to pull the steel core 86*a* into the solenoid 86. This pulling force is strongest when the steel core 86*a* is completely in the solenoid 86, and gradually decreases as the steel core 86*a* is pulled out of the solenoid 86. Thus, when the steel core 86*a* is completely in the solenoid 86, the force of the permanent magnet, which works in the direction to keep the steel core 86*a* in the solenoid 86, is greater than the force of the torsional spring 85, which works in the direction to pull the steel core 86*a* out of the solenoid 86. However, after the steel core 86*a* is pulled out beyond a certain point, the relation between the two forces reverses in terms of magnitude. In other words, past a certain point, the effect (force) of the permanent magnet is weaker than the force of the torsional spring 85. Therefore, the steel core 86*a* is kept out of the solenoid 86 by the torsional coil spring 85. Therefore, as electrical current is flowed through the solenoid 86, the steel core 86*a* is caused to project from the solenoid 86 by the electromagnetic force, while resisting the force of the permanent magnet and being assisted by the force of the torsional coil spring 85, whereas as the current direction is reversed, the steel core 86*a* retreats into the solenoid 86 by the electromagnetic force while resisting the force of the torsional coil spring 85 and being assisted by the force of the permanent magnet.

The means for locking the development rotary 23 is structured as described above. Therefore, as electric current is flowed through the solenoid for approximately 200 msec (normal duration) so that the steel core 86*a* moves in the direction indicated by the arrow mark ϵ2, the actuator 83 rotates in the direction indicated by the arrow mark δ. As a result, the stopper portion 83*a* drops into the slit 81A cut in the periphery of the development rotary 23, locking the development rotary 23. On the other hand, as electrical current is flowed through the solenoid 86 for approximately 200 msec so that the steel core 86*a* moves in the direction indicated by the arrow mark ϵ1, the actuator 83 rotates in the direction opposite to the direction indicated by the arrow mark δ, causing the stopper portion 83*a* to come out of the slit 81A. As a result, the development rotary 23 is unlocked.

The flange 81 of the development rotary 23 has three slits 81A, 81B, and 81C. As the rotary rotation button 47 is pressed, the gear 79*a* is rotated by the driving force from the motor 79. As a result, the gear 81*b* is rotated. Therefore, the development rotary 23 rotates. Then, one of the flags (unillustrated) is detected by the photo-interrupter (unillustrated) fixed to the apparatus main assembly 18, when the development rotary 23 stops, positioning one of the three slits 81A, 81B, and 81C at a point at which the slit aligns with the stopper portion 83*a* of the actuator 83. Next, electric current is flowed through the solenoid 86 for approximately 200 msec in the direction to lock the development rotary 23. As a result, the actuator 83 rotates about the nonrotational axis 18*b* in the direction indicated by the arrow mark δ, causing the stopper portion 83*a* to drop into the slit 81A of the flange 81. Therefore, the development rotary 23 is locked.

The means for locking the development rotary 23 works following the above described procedure.

[Development Cartridge Installation]

Next, referring to FIGS. 19 to 30, the method for installing a development cartridge into the apparatus main assembly 18 will be described. First, a front door 39 of the apparatus main assembly 18 must be opened. As the front door 39 is opened about a hinge 39*a*, a door 43 (hereinafter, "development device cover") is exposed. The development device cover 43 is supported by a hinge 43*a* (FIG. 21) attached to the apparatus main assembly 18. A color development cartridge is installed by opening this development cartridge cover 43. As the front door 39 is opened, the apparatus is forced to stop. More specifically, as the front door 39 is opened, a projection 40 with which the front door 39 is provided turns off an interlock switch (unillustrated). As a result, the apparatus main assembly 18 is cut off from the power source which supplies the apparatus main assembly 18 with electrical power of 24 V. Consequently, the operation of the apparatus stops.

A portion of the development device cover 43 is provided with a transparent window 43*b* which allows the development cartridge identification label, for example, a color label, to be seen so that the type of the development cartridge 20Y (20M and 20C) can be confirmed. If the development cartridge slot for the desired development cartridge is not in alignment with the development device cover 43, preventing the cartridge from being removed, the development rotary 23 can be rotated by pressing the rotary rotation button 47 below the development device cover 43, so that the slot for the desired cartridge aligns with the development device cover 43 to allow the desired cartridge to be removed.

Figure 21:
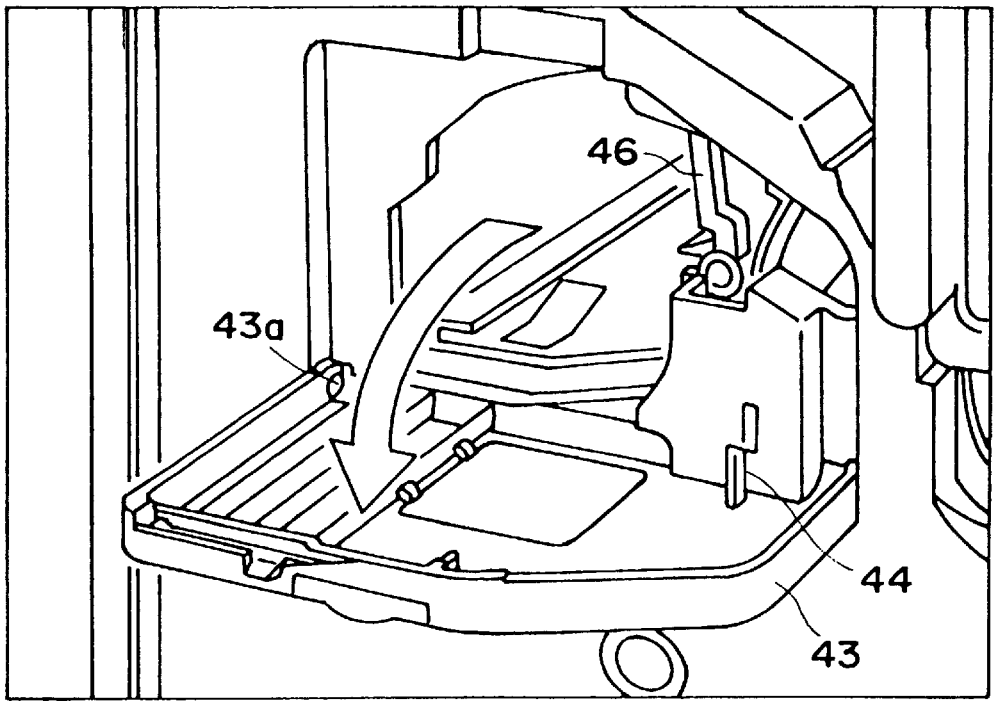
FIG. 21 is a perspective view of one of the development cartridge slots of a development rotary.
Figure 22:
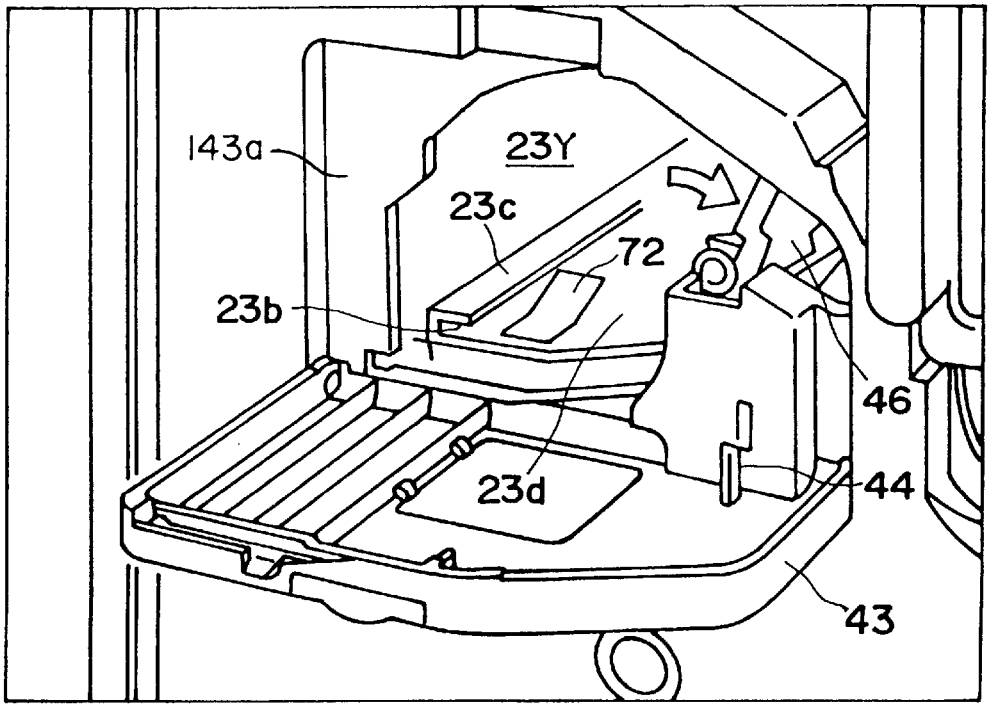
FIG. 22 is a perspective view of one of the development cartridge slot of a development rotary.

After waiting until the development rotary 23 stops in the state in which the desired development cartridge can be installed, the development cartridge cover 43 is opened as shown in FIG. 21. Then, the slot 23Y for the development cartridge 20Y (20M and 20C) must be exposed by turning the release lever 46 in the direction indicated by an arrow mark in FIG. 22. Then, assuming that the development cartridge 20Y is in the exposed cartridge slot, the development cartridge 20Y is taken out of the exposed cartridge slot. Retracing a few steps, as the development device cover 43 is opened to exchange the development cartridge 20Y, a prong 44, an integral part of the cover 44, separates from the switch (unillustrated) which the prong 44 has been holding down, allowing the switch to turn on. As the switch turns on, electrical current is flowed through the solenoid 86, illustrated in FIG. 17, for a brief moment, in the direction to move the movable steel core 86*a* in the direction indicated by the arrow mark ϵ2. As a result, the development rotary 23 is instantly locked.

For example, at times, the density of the toner in the development cartridge 20Y (20M and 20C) can become very high due to the vibrations which occur during the shipment of the cartridge. If the development cartridge in this condition is installed as it is, a very large amount of torque is required at the beginning of an image forming operation. If the density increases beyond a certain level, the apparatus main assembly 18 may not be able to be operated.

Figure 23:
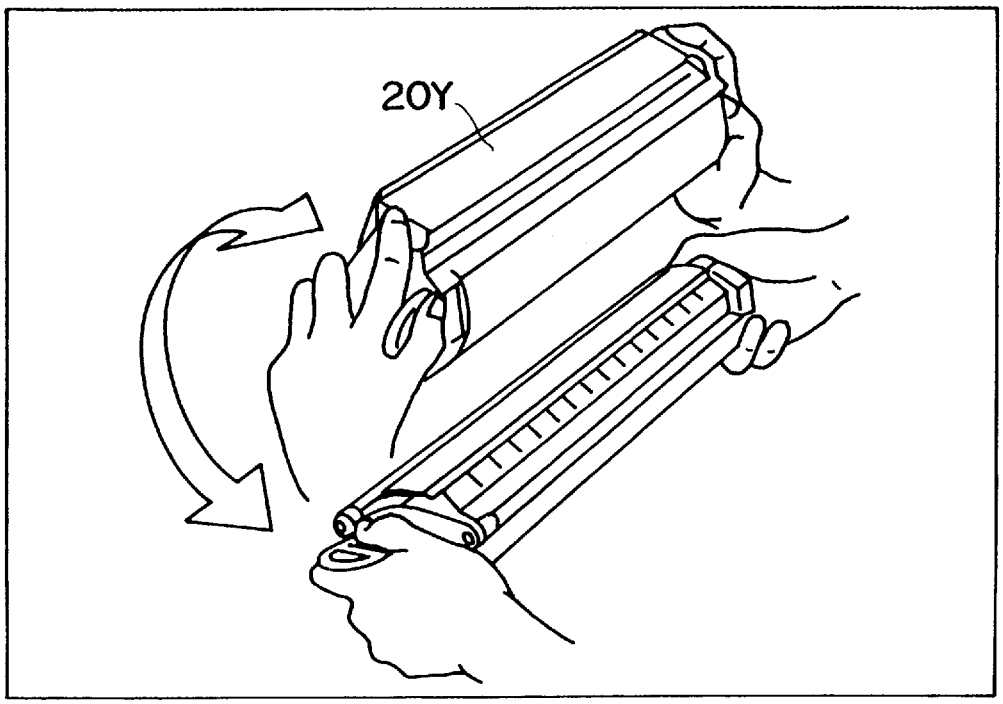
FIG. 23 is a perspective drawing which depicts a step to be taken prior to development cartridge installation.
Figure 24:
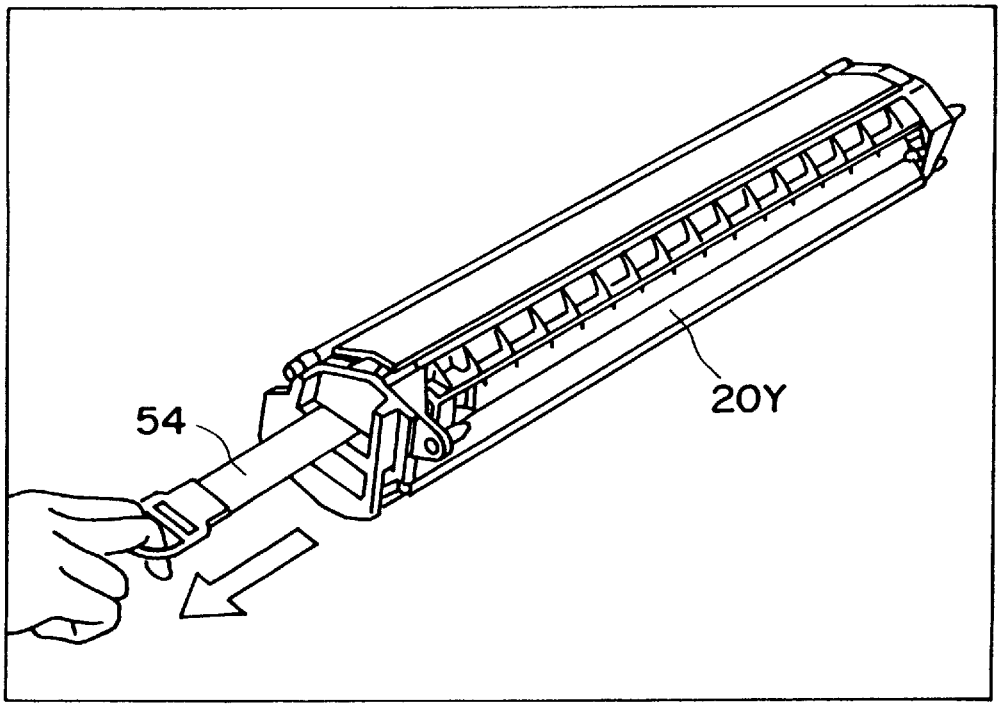
FIG. 24 is a perspective drawing which depicts a step to be taken prior to development cartridge installation.

In order to prevent such a problem, the user must vigorously shake the development cartridge 20Y (20M and 20C), horizontally holding the cartridge, as illustrated in FIG. 23, before installing the cartridge into the apparatus main assembly 18. Then, the user must peels off the toner seal 54 of the development cartridge 20Y by pulling the seal in the direction indicated by an arrow mark in the drawing, so that the toner within the development cartridge 20Y can be supplied to the development roller 20YS. When the seal 54 is pulled, the development cartridge 20Y should be positioned so that the development roller 20YS remains on the top side.

Figure 25:
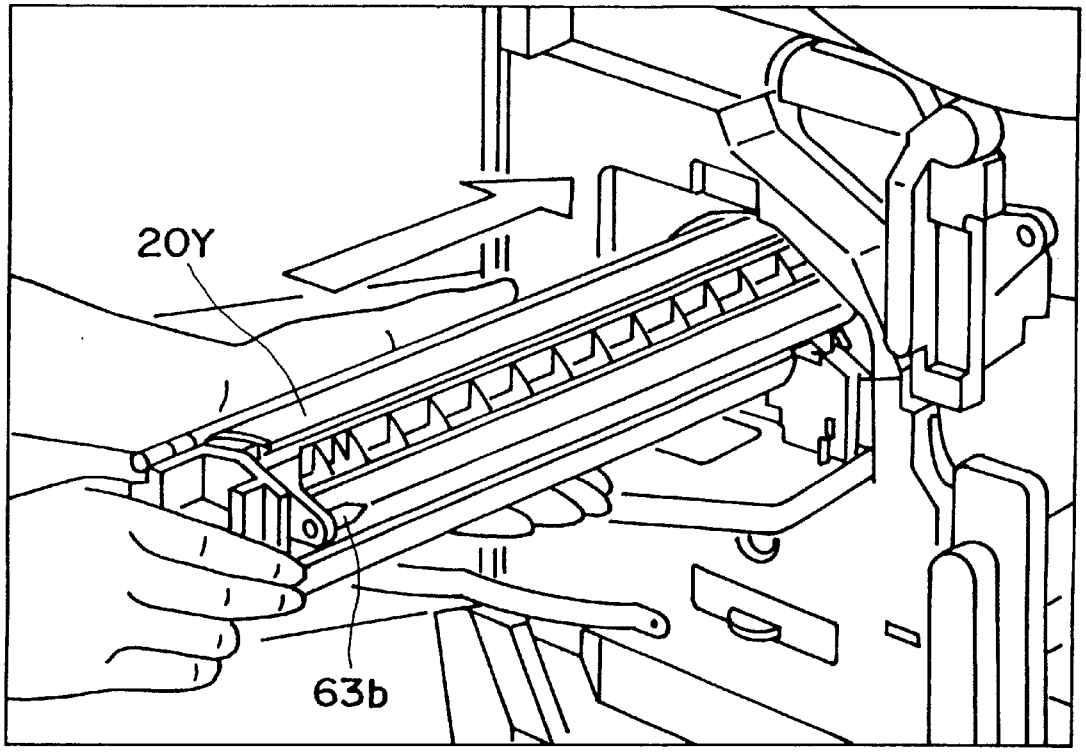
FIG. 25 is a perspective drawing which depicts a development cartridge installation step.
Figure 26:
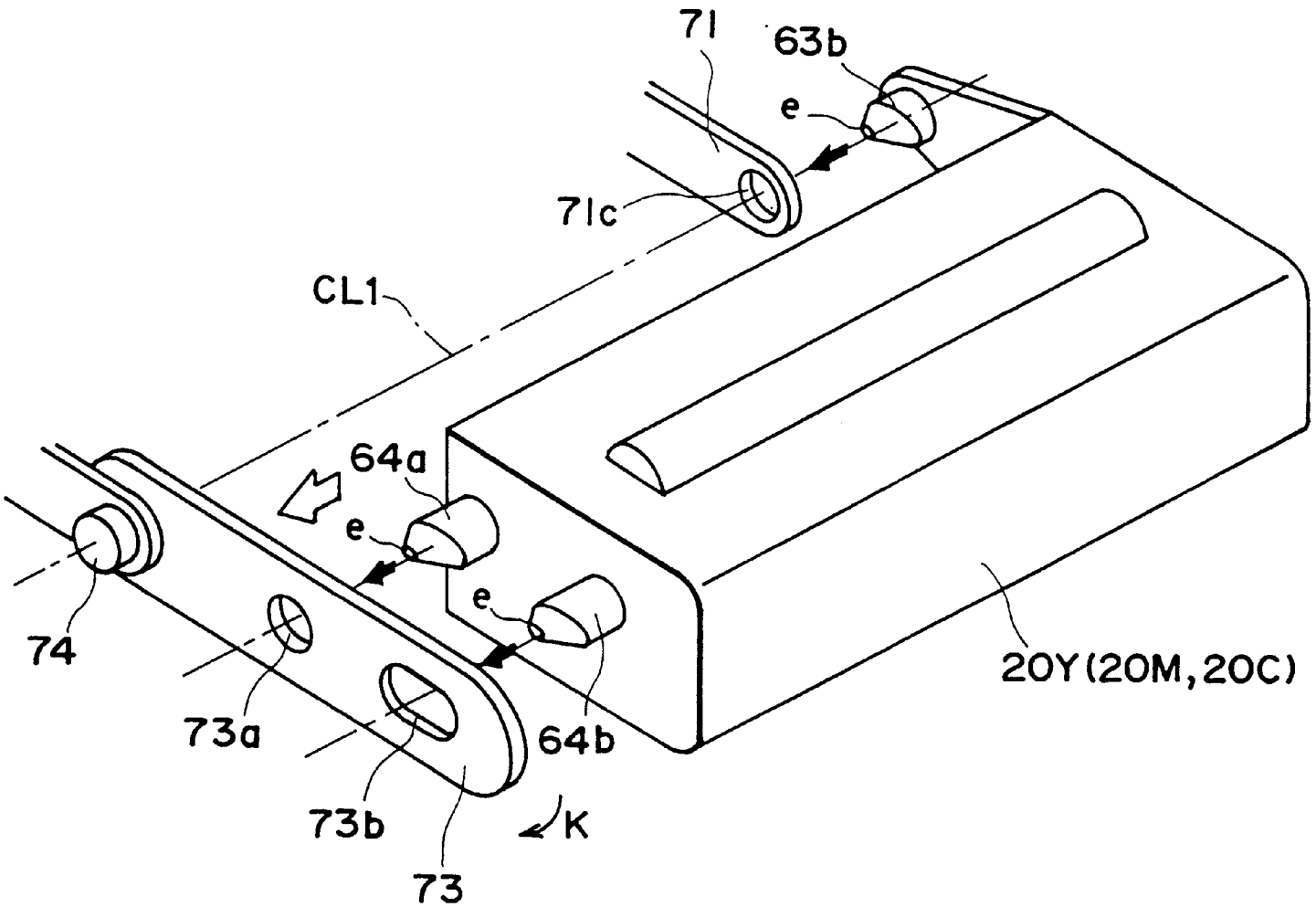
FIG. 26 is a perspective drawing which depicts a development cartridge installation step.

As the development cartridge 20Y which has been in the development rotary 23 is taken out of the development rotary 23, the development cartridge slot 23Y is exposed through the opening 143*a*. A fresh development cartridge 20Y is installed into the development cartridge slot 23Y through the this opening 43*a*, from the rear cover 68 side of the development cartridge 20Y, in the longitudinal direction of the development cartridge 20Y. When installing the development cartridge 20Y, the development cartridge 20Y should be held so that the development roller 20YS remains on the top side, the guide 53*c* of the development cartridge 20Y sliding in the guide groove 23*b* of the development rotary 23 from the front to the rear, and the bottom surface of the developer container 53 sliding on the divider wall 23*d* of the main stay 23*a*. Then, as the guide 53*c* reaches the plate spring 72 of the development rotary 23, the guide 53*c*, that is, the flange portion, of the development cartridge 20Y, it is pinched between the plate spring 23 and the edge member 23*c* of the guide groove 23*b*. As the development cartridge 20Y is further inserted, the guide 53*c* advances, sliding along the edge member 23*c*. Referring to FIG. 25, the rightward movement of the development cartridge 20Y is regulated as the guide 61 of the development cartridge 20Y comes in contact with the surfaces of the guide groove 71*a* of the front stay 71, and a rough guide 24 which extends along the groove 71*a* in the longitudinal direction of the main stay 23*a*. As the development cartridge 20Y is pushed further in the direction indicated by an arrow mark in FIG. 25, the pins 64*a* and 64*b* located on the rear side of the development cartridge advance toward the positioning holes 73*a* and 73*b*, respectively, of the pivotal arm 73 attached to the flange 81. The pin 63*b* on the front side advances toward the positioning hole 71*c* of the front stay 71.

The end portion of each positioning pin, 63*b*, 64*a*, and 64*b*, is tapered so that when the development cartridge 20Y is positioned as illustrated in FIG. 25, the position of the tip e of each pin becomes higher than the position of the axial line of the cylindrical pin. Therefore, as the development cartridge 20Y is pushed in further, the pins 63*b*, 64*a*, and 64*b* enter the corresponding positioning holes 71*c*, 73*a*, and 73*b*, and come in contact with the edges of the positioning holes, at the portions below the centers of the holes, by the tapered sections below the tips e. As a result, the development cartridge 20Y is lifted at three points, and the bottom of the developer container 53 of the development cartridge 20Y separates from the main stay 23*a*. The guide 53*c* has been subjected to the force generated upward by the two plate springs 72 attached to the main stay 23*a*, one being positioned adjacent to the entrance of the development cartridge slot and the other being positioned at the middle in terms of the longitudinal direction of the main stay 23*a*. Therefore, the entire weight of the development cartridge 20Y does not rest on the edges of the positioning holes 73*a* and 73*b* through the pins 64*a* and 64*b*, respectively. As a result, the development cartridge 20Y rotates upward about the positioning pin 63*b* at the front and the pin (shaft) 74 at the rear.

Figure 27:
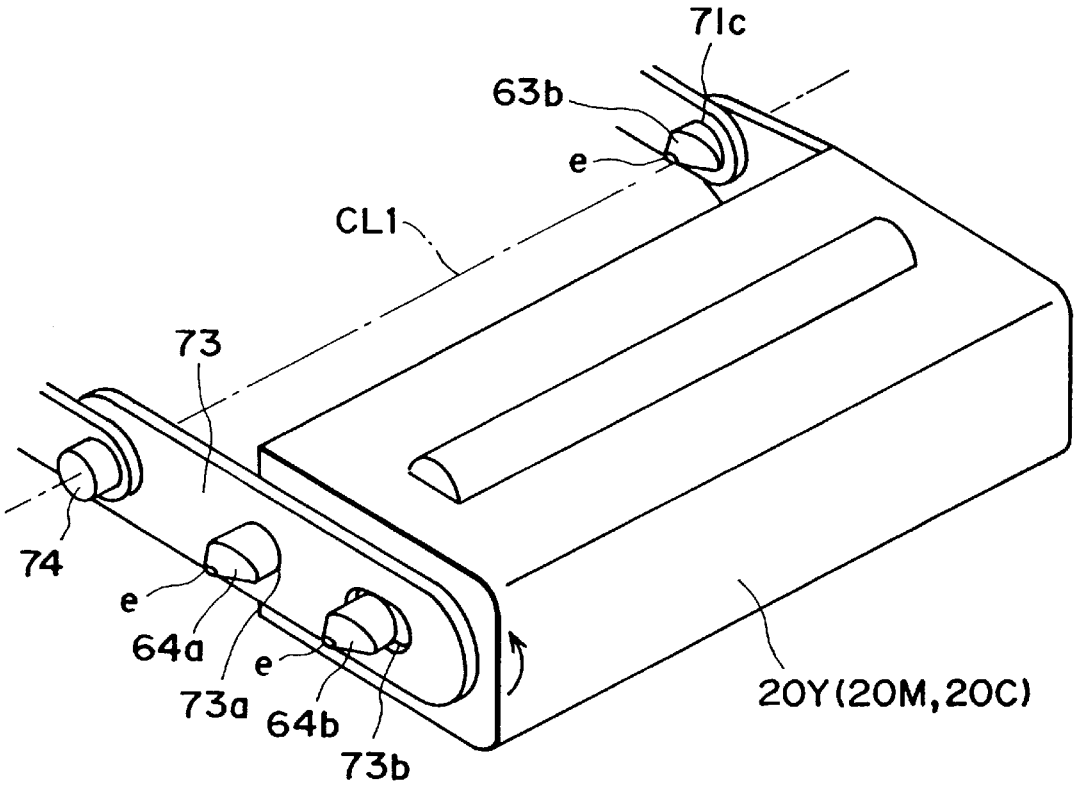
FIG. 27 is a perspective drawing which depicts a development cartridge installation step.
Figure 28:
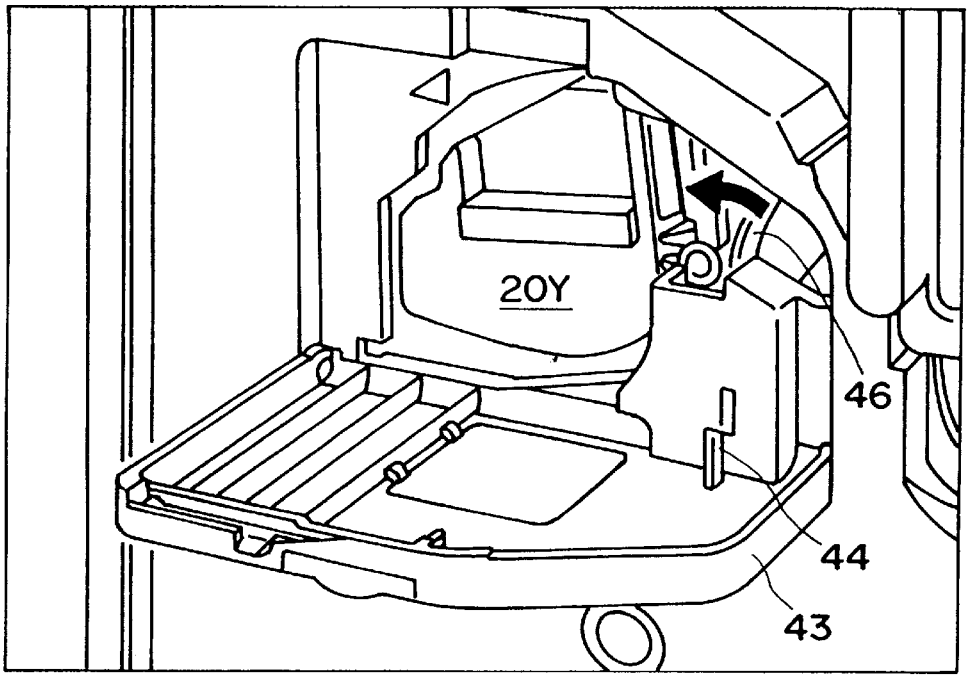
FIG. 28 is a perspective drawing which depicts a development cartridge installation step.
Figure 29:
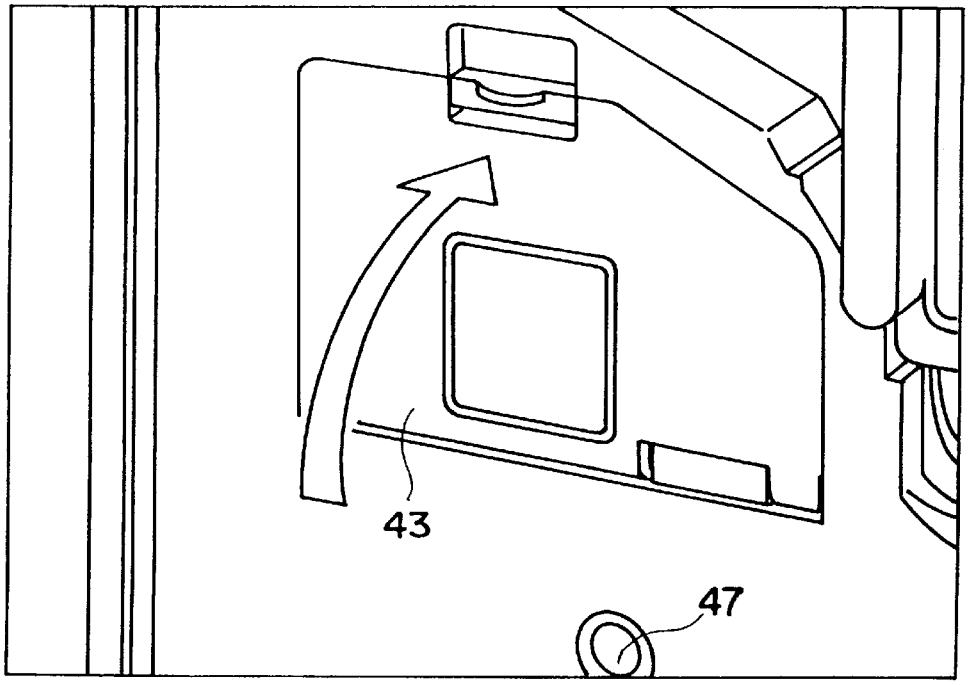
FIG. 29 is a perspective drawing which depicts a development cartridge installation step.

As the development cartridge 20Y is pushed in further, the positioning pins 63*b*, 64*a*, and 64*b* of the development cartridge 20Y fully engage with the correspondent positioning holes 71*c*, 73*a*, and 73*b* of the development rotary 23 as shown in FIG. 27. In the state depicted in FIG. 27, the projection 68Ya, the developing cartridge identifying portion of the development cartridge 20Y, has fit in the recess 87Y, the development cartridge identifying portion, on the main assembly side, and the rib 87Ya which crosses the recess 87Y fits into the gap 68Yb between the two separate portions of the projection 68Ya. As a result, the development cartridge 20Y for yellow color is allowed to properly fit in the development cartridge slot 23Y.

Referring to FIG. 18, as described previously, the development rotary 23 is provided with the slot 23Y for the development cartridge 20Y for yellow color, slot 23M for the development cartridge 20M for magenta color, and slot 23C for the development cartridge 20C for cyan color. The flange 81 is provided with recesses 87Y, 87M, and 87C which accept the projections of the development cartridge 23Y, 23M, and 23C.

The recesses 87Y, 87M and 87C are identically positioned relative to the corresponding development cartridge slots 23Y, 23M, and 23C. They have an elongated shape, being identical in size and contour, and extend in the direction perpendicular to the radial direction of the flange 81. They are disposed relatively close to the center of flange 81. The ribs 87Ya, 87Ma, and 87Ca are disposed in the corresponding recesses 87Y, 87M, and 87C, being different in their positions relative to the corresponding recesses, so that as the development cartridges 20Y, 20M, and 20C are installed into their slots, they fit into the corresponding gaps 68Yb, 68Mb, and 68Cb of the corresponding projections 68Ya, 68Ma, and 68Ca.

In other words, as the development cartridge 20Y is installed into the development cartridge slot 23Y, the projection 68Y perfectly engages with the recess 87Y. But, if the development cartridge 20Y for yellow color is installed into the development cartridge slot 28M for magenta color or the development cartridge slot 28C for cyan color, the projection 68Ya collides with the rib 87Ma of the recess 87M, or rib 87Ca of the recess 87C, preventing the development cartridge 20Y from being properly seated in the slot. Thus, the development cartridge 20Y can be installed only into the slot 23Y for the development cartridge 20Y for yellow color; it cannot be installed into the slot 23M for the development cartridge 20M for magenta color and the slot 23C for the development cartridge 20C for cyan color.

Similarly, the development cartridge 20M for magenta color can be installed into only the slot 23M for the development cartridge 20M for magenta color, and the development cartridge 20C for cyan color can be installed into only the slot 23C for the development cartridge 20C for cyan color. In other words, the development cartridges can be prevented from being installed into improper slots.

Referring to FIG. 27, as the development cartridge 20Y is installed into the slot 23Y for the development cartridge 20Y for yellow color, the guide 53*c* of the development cartridge 20Y is pushed upward by the plate spring 72. Therefore, the development cartridge 20Y pivots about the pin (shaft) 74, as shown in FIG. 27, as far away as possible from the central axis of the development rotary 23, and remains there. Thus, as the development cartridge 20Y is moved to the development station at which the development roller 20YS of the development cartridge 20Y comes in contact with the photosensitive drum 15, the development roller 20YS is pushed by the photosensitive drum 15. As a result, the guide 53*c* bends the plate spring 72.

When the development cartridge 20Y is in the slot 23Y for the de23Y for yellow color, the longitudinal ends of the light transmitting members 57 and 58, which are exposed from the end surface of the projection 68Ya provided to identify a development cartridge, are aligned with the through holes 88 and 89, respectively, located at the bottoms of the longitudinal ends, one for one, of the recess 87Y, that is, the development cartridge identifying portion on the main assembly side. Thus, as the development cartridge 20Y which has been installed in the development rotary 23Y is moved to the development station, the light transmitting members 57 and 58 align, through the through holes 88 and 89, with the light emitter 59*a* and light sensor 59*b* fixed to the apparatus main assembly 18, as shown in FIG. 6.

As described above, the development cartridge 20Y is inserted into its slot in the direction indicated by an arrow mark in FIG. 25, while being held so that the development roller 20YS stays at the top. The pin 63*b* of the development cartridge 20Y fits into the positioning hole 71*c* of the development rotary 23. The insertion of the development cartridge 20Y is completed as the base portion 63*c* (FIG. 12) of the positioning pin 63*b* of the development cartridge 20Y properly settles into the seat portion 71*d* (FIG. 16) of the positioning hole 71*c* of the front stay 71. Then, in order to prevent the development cartridge 20Y from coming out forward on rare occasions, the release lever 46 is returned in the direction indicated by an arrow mark in FIG. 28.

Next, the developing device cover 43 is closed in the direction indicated by the arrow mark in the drawing to end the installation of the development cartridge 20Y. The development cartridge installation procedure described above with reference to the development cartridge 20Y is repeated three times to install three development cartridges 20Y, 20M, and 20C.

Figure 30:
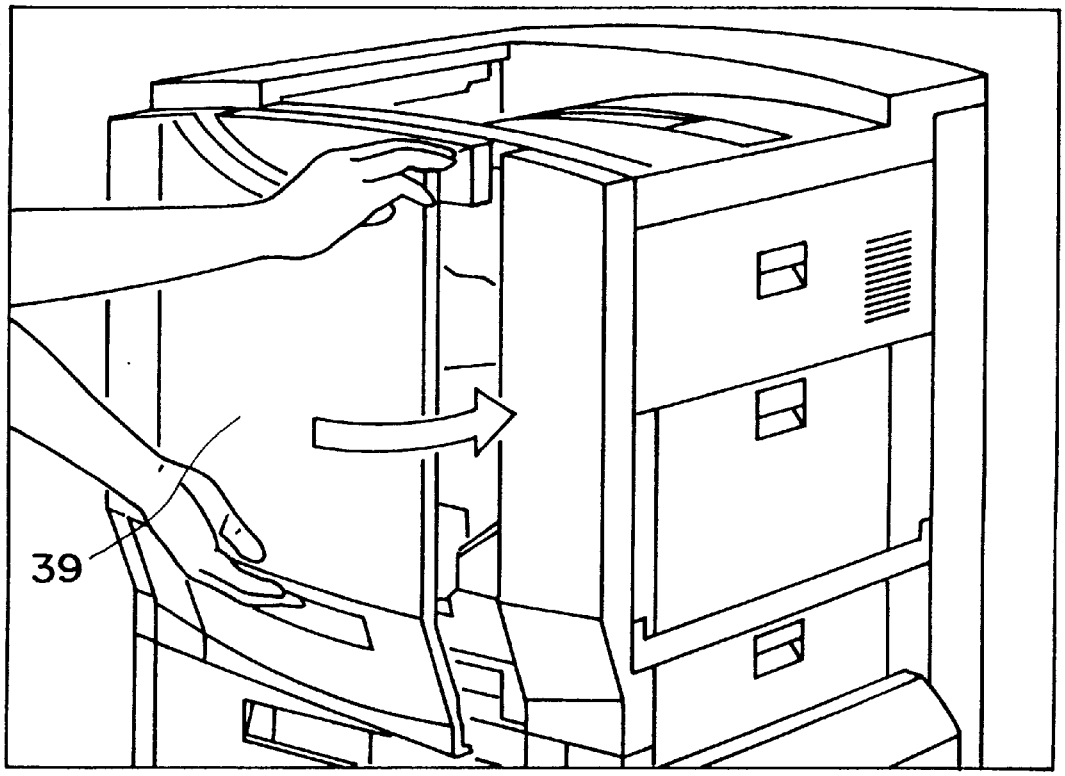
FIG. 30 is a perspective drawing which depicts a development cartridge installation step.

Finally, the front door 39 is closed as shown in FIG. 30.

As described above, according to this embodiment, the development cartridge identifying portion is provided on both the apparatus main assembly side and development cartridge side, in such a manner that when one of the development cartridge identifying portions on the apparatus main assembly side does not match the development cartridge identifying portion of one of the development cartridges, this development cartridge cannot be installed into the development cartridge slot with this development cartridge identifying portion. Therefore, if a user inserts a development cartridge into a wrong development cartridge slot, the user will immediately notice the mistake. More specifically, in order to prevent a development cartridge from being installed into a wrong development cartridge slot, a development cartridge for one color is made different from the development cartridges for other colors in the position of the gap of a projection on the development cartridge side. Therefore, the projection on the cartridge side can be integrally formed with the cover 68. Further, all that is necessary to make the position of the gap of the projection of a development cartridge for one color different from the positions of the gap of the projection of a development cartridge for another color is to slightly modify the metallic mold for the cover 68. Therefore, the metallic mold for the cover 68 for a development cartridge for one color can be used for manufacturing the cover 68 for a development cartridge for another color.

While the invention has been described with reference to the structures disclosed herein, it is not confined to the details set forth, and this application is intended to cover such modifications or changes as may come within the purposes of the improvements or the scope of the following claims.

What is claimed is:

1. A developing cartridge detachably mountable to a main assembly of an image forming apparatus comprising:

a toner carrying member for carrying toner to a developing station at which an electrostatic image formed on an image bearing member is developed with the toner;

a toner accommodating portion for accommodating the toner to be supplied to said toner carrying member;

an engaging portion, a shape of which is different depending on the type of the toner it contains, and which is engageable with an engaging part of one of two or more developing cartridge slots provided in the main assembly of the image forming apparatus; and a light transmitting portion disposed in said engaging portion to transmit light to be detected by detecting means provided in the main assembly of the image forming apparatus to detect an amount of the toner in said toner accommodating portion.

2. A developing cartridge according to claim 1, wherein said engaging portion is located at the front end of said developing cartridge in terms of the direction in which said developing cartridge is inserted into the main assembly of the image forming apparatus.

3. A developing cartridge according to claim 2, wherein said engaging portion is provided with a projection.

4. A developing cartridge according to claim 2, wherein said light transmitting portion comprises a light entrance through which the toner detection light from the main assembly of the image forming apparatus enters said light transmitting portion, and a light exit through which the toner detection light exits in the direction parallel to the direction in which the toner detection light enters said light transmitting portion.

5. A developing cartridge according to claim 4, wherein said engaging portion comprises first and second projections, and wherein said light entrance and exit are in said first and second projections, respectively.

6. A developing cartridge according to claim 5, wherein a gap is provided between said first and second projections, and the position of said gap varies according to the type of the toner within said developing cartridge.

7. An image forming apparatus, in which a plurality of developing cartridges, different in the type of the toner they hold, can be removably installed, comprises:

a plurality of developing cartridge slots in which said plurality of developing cartridges are correspondingly installed, each of the plurality of developing cartridges comprising: a toner carrying member for carrying toner to a developing station at which an electrostatic image formed on an image bearing member is developed with the toner; a toner accommodating portion for accommodating the toner to be supplied to said toner carrying member; a developing-cartridge engaging portion, the shape of which is different depending on the type of the toner it contains, and which is engageable with a main-assembly engaging portion of one of two or more developing cartridge slots provided in a main assembly side of the image forming apparatus; and a light transmitting portion disposed within said developing-cartridge engaging portion to transmit the light to be detected by a detecting means provided on the main assembly side of the image forming apparatus to detect the amount of the toner within said toner accommodating portion; and means for detecting the amount of the toner in said toner accommodating portion with the use of light;

wherein said plurality of developing cartridge slots comprise the main-assembly engaging portion capable of engaging with the developing-cartridge engaging portion of the developing cartridge which each developing cartridge slot accepts, and wherein the main-assembly engaging portion of each developing cartridge slot is different in shape depending on the shape of the developing-cartridge engaging portion of the developing cartridge which the developing cartridge slot accepts, and wherein said detecting means comprises a light transmitting portion through which the toner detection light is allowed to pass, and wherein said light transmitting portion is in said main-assembly engaging portion of the developing cartridge slot.

8. An image forming apparatus according to claim 7, wherein said main-assembly engaging portion of each developing cartridge slot is located where it opposes the front end of the developing cartridge in terms of the direction in which a developing cartridge is installed into a developing cartridge slot.

9. An image forming apparatus according to claim 8, wherein said main-assembly engaging portion of each developing cartridge slot comprises a recess which engages with said developing-cartridge engaging portion of the developing cartridge side.

10. An image forming apparatus according to claim 9, wherein said light transmitting portion includes first and second through holes which align with a light entrance and a light exit of a developing cartridge, through which the toner detection light enters and exits from, respectively, the developing cartridge.

11. An image forming apparatus according to claim 9, wherein each of said developing-cartridge engaging portions of said plurality of developing cartridges comprises a first projection exposed to exit light, and a second projection exposed to entrance light, wherein a gap is provided between said first and second projections, and wherein said main-assembly engaging portion of said plurality of developing cartridge slots comprises a rib, which divides said recess into two sections, fits into said gap between the first and second projections on the developing cartridge side, and said gap varies in position according to the type of the toner contained in a specific cartridge installed in each developing cartridge slot.

12. An image forming apparatus according to claim 7, wherein each of said plurality of developing cartridge slots supports a developing cartridge so that said toner carrying member is allowed to move to the developing station at which the toner carrying member is activated, and said main-assembly engaging portion of each of said plurality of developing cartridge slots loosely engages with said developing-cartridge engaging portion on the developing cartridge side to allow developing cartridge movement.

13. An image forming apparatus according to claim 7, wherein said plurality of developing cartridge slots can be moved in a circle to selectively move any of the plurality of developing cartridges in the corresponding developing cartridge slots to the developing station.

14. An image forming apparatus according to claim 7, wherein the toner contained in each of said plurality of developing cartridges is different in color.

* * * * *

UNITED STATES PATENT AND TRADEMARK OFFICE

CERTIFICATE OF CORRECTION

PATENT NO. : 6,151,459
DATED : November 21, 2000
INVENTOR(S) : Kouji Hashimoto, et al.

It is certified that error appears in the above-identified patent and that said Letters Patent is hereby corrected as shown below:

Column 17,
Line 24, "peels" should read -- peel --.

Column 19,
Line 22, "de23Y for" should be deleted.

Signed and Sealed this

Sixth Day of November, 2001

*Attest:*

Nicholas P. Godici

NICHOLAS P. GODICI
*Acting Director of the United States Patent and Trademark Office*

*Attesting Officer*